US008197040B2

(12) United States Patent
Yokouchi

(10) Patent No.: US 8,197,040 B2
(45) Date of Patent: Jun. 12, 2012

(54) LIQUID SUPPLY DEVICE AND LIQUID EJECTING APPARATUS

(75) Inventor: Hideya Yokouchi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 391 days.

(21) Appl. No.: 12/507,621

(22) Filed: Jul. 22, 2009

(65) Prior Publication Data

US 2010/0020137 A1 Jan. 28, 2010

(30) Foreign Application Priority Data

Jul. 23, 2008 (JP) ..... 2008-190204

(51) Int. Cl.
*B41J 2/175* (2006.01)

(52) U.S. Cl. ..... 347/85

(58) Field of Classification Search ..... 347/65, 347/66, 84, 85; 141/2, 18
See application file for complete search history.

(56) References Cited

U.S. PATENT DOCUMENTS

| | | | | |
|---|---|---|---|---|
| 5,854,646 | A * | 12/1998 | Barinaga et al. | 347/85 |
| 6,322,207 | B1 * | 11/2001 | Hall et al. | 347/85 |
| 6,652,080 | B2 * | 11/2003 | Childs et al. | 347/85 |
| 6,676,006 | B2 * | 1/2004 | Ishida | 228/42 |

FOREIGN PATENT DOCUMENTS

| | | |
|---|---|---|
| JP | 2002-192751 | 7/2002 |
| JP | 2005-297330 | 10/2005 |
| JP | 2006-272661 | 10/2006 |

* cited by examiner

*Primary Examiner* — Anh T. N. Vo
(74) *Attorney, Agent, or Firm* — Workman Nydegger

(57) ABSTRACT

A liquid supply device includes: a supply pump which is provided in a liquid supply passage; a first unidirectional valve which is provided on an upstream side of the supply pump; a second unidirectional valve which is provided on a downstream side of the supply pump; a first member; a second member; and a flexible member. The supply pump and the first and second unidirectional valves are formed such that the flexible member is interposed between the first and second members and held by locking a locking unit in the state where the flexible member is interposed between the first and second members.

9 Claims, 15 Drawing Sheets

LIQUID SUPPLY DEVICE AND LIQUID EJECTING APPARATUS

BACKGROUND

The entire disclosure of Japanese Patent Application No. 2008-190204, filed Jul. 23, 2008, is expressly incorporated herein by reference.

1. Technical Field

The present invention relates to a liquid supply device including a supply pump provided in a liquid supply passage, a first unidirectional valve provided in the upstream side of the supply pump, and a second unidirectional valve provided on the downstream side of the supply pump, and a liquid ejecting apparatus.

2. Related Art

In the past, an ink jet printer as a liquid ejecting apparatus printed a text, an image, or the like by ejecting ink droplets as a liquid onto a target (a sheet, etc.) from a printing head. An ink cartridge (a liquid storing member) as an ink supply source supplying ink to the printing head is mounted on such a kind of printer. As an ink supplying method of supplying ink from the ink cartridge to the printing head, there is known a method of using a water head difference based on a difference between an ink surface of the ink cartridge and the height of nozzles of the printing head or a method of supplying ink by use of a pump.

In the ink supply device (a liquid supply device) using the pump, there is known a pressurizing supply method (for example, JP-A-2002-192751 (FIG. 2, etc.)) of supplying ink by sending air pressurized by a pressurizing pump to an ink cartridge and pressurizing an ink pack accommodated in the ink cartridge or a method (JP-A-2006-272661 (FIGS. 2, 4, 6, 8, 10, etc.)) of supplying ink by driving a pump provided in an ink passage and ejecting the ink sucked from an ink cartridge located on the upstream side of the ink passage toward the downstream side of the ink passage.

An ink supply device disclosed in JP-A-2062-272661 includes a pulsation type pump such as a diaphragm type pump and a pair of unidirectional valves (check valves) provided in the upstream side (an input side) and the downstream side (an output side) of the pump, respectively. The unidirectional valve (a first unidirectional valve) on the upstream side is opened by the depressurization of the ink upon the sucking drive of the pump, and maintains a valve-closed state when the pressure of the ink is increased upon the ejecting drive of the pump. On the other hand, the unidirectional valve (a second unidirectional valve) on the downstream side maintains a valve-closed state upon the sucking drive of the pump and is opened when the pressure of the ink is increased upon the ejecting drive of the pump.

In the ink supply device disclosed in JP-A-2062-272661, the pumps and the first and second unidirectional valves are formed by interposing a flexible member (a diaphragm forming member) between upper and lower cases. In this configuration, a part of the flexible member functions as a diaphragm of the pump and another part of the flexible member functions as a valve body of the unidirectional valve.

Since the portion around the pump and the valves in the flexible member function as a sealing portion, the upper and lower cases have to be joined in a compressed state to the flexible member. In the past, a method of joining the upper and lower cases was performed by fastening fastening members such as screws or bolts.

However, when the tightening force is too strong due to the non-uniformity of the tightening force of screws, the flexible member is excessively pressed and deformed. In this case, even when the sealing portion of the portion around the pump and the valves in the flexible member is excessively pressed and deformed, a sealing function is not damaged.

However, in some cases, a part of rubber or the like excessively pressed and deformed is pushed toward the pump chamber or the inside of the valve chamber and thus the diaphragm or the valve body becomes loose. For example, when the valve body becomes loose, the time taken to open or close the unidirectional valve may be different from the designed time, thereby causing non-uniformity in the opening or closing time. The non-uniformity in the opening or closing time results in a delay of the valve closing time or the valve closeness of the first unidirectional valve (a sucking valve) on the upstream side and the second unidirectional valve (an ejecting valve) on the downstream side not completely closing, for example. In this case, when a delay of the valve closing time of the ejecting valve occurs upon starting the sucking drive or the valve does not completely close, the ink on the downstream area is depressurized and thus a necessary ink pressurizing value may not be guaranteed or the delay of the valve closing time of the sucking valve may occur upon starting the ejecting drive. Alternatively, when the delay of the valve closing time of the sucking valve occurs upon starting the ejecting drive or the valve does not completely close, the ink which has to be ejected may flow backward to the ink cartridge. In particular, when the valve closeness of the sucking valve is incomplete, a problem occurs in that the ink pressurized in the liquid supply device flows backward and thus leaks from the ink supply needle when the ink cartridge is detached to exchange the ink cartridge. Moreover, when the upper and lower cases are joined by the use of the fastening members such as screws, the work required for fastening the fastening members such as plural screws becomes very troublesome.

SUMMARY

An advantage of some aspects of the invention is that it provides a liquid supply device including a supply pump and unidirectional valves provided on the upstream side and downstream side of the supply pump, being formed by finishing an assembling work for assembling first and second members with a flexible member interposed therebetween in a relatively simple manner, and preventing the flexible member from being excessively pressed and deformed, and a liquid ejecting apparatus.

According to an aspect of the invention, there is provided a liquid supply device including: a supply pump which is provided in a liquid supply passage; a first unidirectional valve which is provided on an upstream side of the supply pump; a second unidirectional valve which is provided on a downstream side of the supply pump; a first member; a second member; and a flexible member. The supply pump and the first and second unidirectional valves are formed such that the flexible member is interposed between the first and second members and held by locking a locking unit in the state where the flexible member is interposed between the first and second members.

According to this aspect of the invention, the flexible member is held in a pressurized and inserted between the first and second members by the locking of the locking unit. For example, the liquid supply device can be simply assembled, compared to a configuration in which the liquid supply device is assembled by fastening fastening members such as screws or bolts. In the case of the configuration in which the flexible member is pressurized by and inserted between the first and second members by use of the fastening members, the flexible member may be excessively pressed and deformed when the flexible member is excessively strongly tightened with the non-uniformity in the tightening force of the fastening members. When the flexible chamber is excessively pressed and deformed, opening or closing time of the unidirectional valve, for example, may be different from designed time. That is, various problems occur. However, the flexible member is pressurized by and inserted between the first and second members by the locking of the locking unit, the gap between the first and second members is determined so as to be nearly uniform at the locking positions of the locking unit. Moreover, there is no problem that the gap between the first and second members excessively narrowed due to the excessive tightening force, which is a problem caused when the fastening members are used. As a consequence, since the flexible member is not excessively pressed and deformed, it is possible to avoid the problem caused when the flexible member is excessively pressed and deformed. For example, when the flexible member is excessively pressed and deformed in the periphery of the valves in a case in which the valves of the unidirectional valve are formed by a part of the flexible member, the pressed and deformed portion enters the valve chamber and thus causes the valves to become loose. Thus, this may cause the non-uniformity in the opening or closing time of the unidirectional valve or the incompleteness of the valve closing. However, according to this aspect of the invention capable of preventing the flexible member from being pressed and deformed, this non-uniformity in the opening or closing time does not occur. Moreover, the unidirectional valve can be surely closed when the unidirectional valve has to be closed.

In the liquid supply device according to the aspect of the invention, the locking unit may hold a plurality of members including the first and second members by locking and include a locking member which is provided in one outer member of the plurality of members and a lockable member which is provided in another outer member thereof disposed opposite to the one outer member and engages with the locking member.

According to the aspect of the invention, the first and second members pressurize and interpose the flexible member by engaging the locking member provided in one of the plurality of members including the first and second members with the lockable member provided in another member. That is, since the locking unit is provided as a part of the plurality of members forming the liquid supply device, the number of components is small. Moreover, since the locking member engages with the lockable member upon assembling the members, the assembling work is also simplified.

In the liquid supply device according to the aspect of the invention, a metal plate which is one of the plurality of members may be disposed on the surface of at least one of the first and second members opposite to the flexible member, and the locking member may lock the lockable member formed on the metal plate.

According to the aspect of the invention, even when the first and second members are made of a plastic material, the metal plate as the member of the plurality of members may be disposed on the surface of at least one of the first and second members opposite to the flexible member. By engaging the locking member with the lockable member formed in the metal plate, the first and second members pressurize and interpose the flexible member. Accordingly, even when the first and second members are pressed stronger in the locking positions than in the other positions and thus the distribution of the force occurs, the first and second members are not deformed in the rippling shape, for example, and the flatness is ensured by the rigidity of the metal plate. As a consequence, the sealing property can be ensured between the first and second members and the flexible member.

In the liquid supply device according to the aspect of the invention, the lockable member may have a plate spring which is elastically deformable and the locking member engaging with the above locking member is formed in the plate spring.

According to the aspect of the invention, since the elasticity of the plate spring serves as a cushion in the locking state of the locking unit, the engagement of the locking member with the lockable member is rarely released. For example, it is possible to prevent the engagement of the locking member with the lockable member from being released because the flexible member receives the strong compression reacting force.

In the liquid supply device according to the aspect of the invention, the locking unit may include first locking members which lock at a plurality of positions in the circumference of a main body formed by interposing the flexible member between the first and second members and second locking members which lock at locking positions located more inside than the locking positions of the first locking members in the main body.

According to the aspect of the invention, since the first locking members lock at the plurality of positions in the circumference of the main body and the second locking members lock at the locking positions in more inside than the locking positions, the first and second members are not detached by the compression reacting force received from the flexible member and thus the whole surface of the flexible member can be surely pressurized. Accordingly, it is possible to further ensure the sealing property of the supply pump and the unidirectional valve.

In the liquid supply device according to the aspect of the invention, the second locking member may have a plate spring.

According to the aspect of the invention, the second locking members which lock at the locking positions inside the main body each have the plate spring. Therefore, even when the flexible member is relatively strongly pressurized in the sealing portions in more inside than the circumference of the main body, the spring elasticity of the plate spring serves as a cushion. Therefore, it is possible to prevent the flexible member from being excessively pressed and deformed, while ensuring the sealing property in the sealing portions. In addition, the second locking members can surely pressurize the whole surface of the flexible member even in the inside of the main body without the detachment of the second member from the first member by the compression reacting force received from the flexible member. Accordingly, it is possible to further ensure the sealing property of the supply pump and the unidirectional valves.

The liquid supply device according to the aspect of the invention may further include a plurality of liquid supply units which each include the supply pump and the first and second unidirectional valves. Plural pairs of the supply pumps and the first and second unidirectional valves individually forming the plurality of liquid supply units may be disposed on the substantially same plane. At least one of the first and second members may be provided with concave sections for each forming a part of each chamber of the supply pump and each unidirectional valve. The locking positions of the second locking members may be located in gap areas where the concave sections are not disposed.

According to the aspect of the invention, the second locking members may lock the gap areas as the locking positions where the concave sections formed by the plural pairs of the supply pumps and the first and second unidirectional valves are not disposed. Accordingly, since the flexible member can be surely inserted between the first and second members by a necessary pressurizing force at the positions in the circumference of the supply pumps and the unidirectional valves, it is possible to further ensure the sealing property of the plural pairs of supply pumps and the unidirectional valves.

In the liquid supply device according to the aspect of the invention, at least one of the first and second members may have a groove on a surface opposite to the flexible member. A part of the liquid supply passage may be formed on a surface of at least one of the first and second members opposite to the supply pumps by a spatial area surrounded by the groove and a blocking member by fixing the blocking member on the surface provided with the groove in a sealed state. The locking positions of the locking unit may be located in gap areas where a part of the liquid supply passage is not formed.

According to the aspect of the invention, since a part of the liquid supply passage is formed by the spatial area surrounded by the groove and the blocking member by fixing the blocking member onto the surface of at least one of the first and second members opposite to the surface of the flexible member (the supply pumps) in the sealed state, it is possible to make the liquid supply device compact. In addition, since the locking position is set in the gap area of the part of the liquid supply passage, the part of the liquid supply passage can engage with the member provided on the surface opposite to the surface of the supply pumps.

According to another aspect of the invention, there is provided the liquid supply device according to the aspect of the invention; and a liquid ejecting unit which ejects a liquid supplied from the liquid supply device.

According to this aspect of the invention, since the liquid ejecting device includes the liquid supply device according to the aspect of the invention to supply the liquid to the liquid ejecting unit, it is possible to obtain the same advantages as those of the liquid supply device according to the aspect of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an ink jet printer (hereinafter, referred to as "a printer") which is an example of a liquid ejecting apparatus according to an embodiment of the invention will be described with reference to FIGS. 1 to 16.

Figure 1:
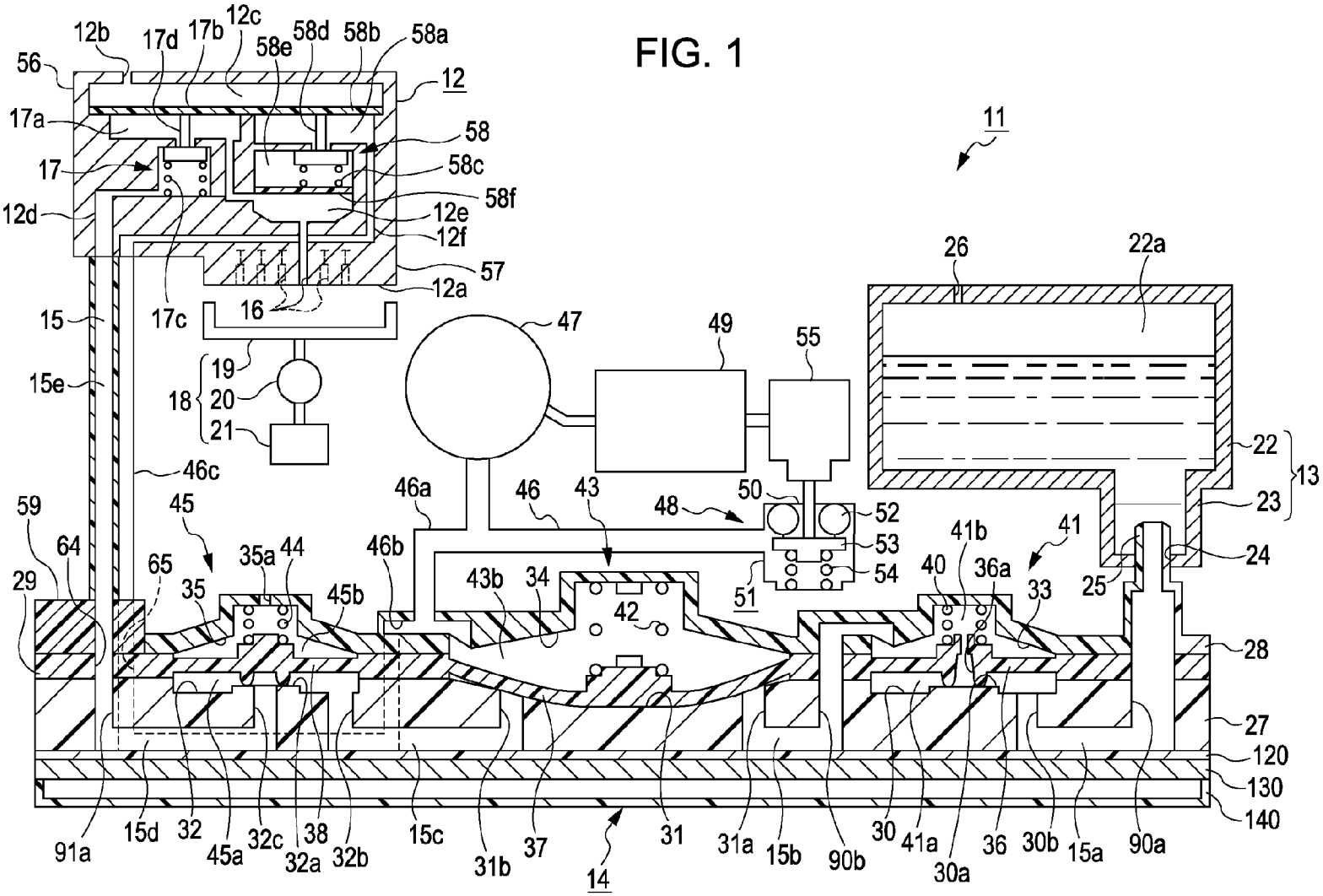
FIG. 1 is a schematic sectional view illustrating an ink jet printer according to an embodiment.

As shown in FIG. 1, a printer 11 according to this embodiment includes a printing head unit 12 as a liquid ejecting unit which ejects ink (liquid) onto a target (for example, a print medium such as a sheet) (not shown) and an ink supply device 14 (a liquid supply unit) which supplies the ink stored in an ink cartridge 13 as a liquid storing member (liquid supply source) to the printing head unit 12. When the upstream end of the ink supply device is connected to the ink cartridge 13 and the downstream end of the ink supply device is connected to the printing head unit 12, a part of an ink passage 15 supplying the ink from an upstream side, which is the ink cartridge 13, to a downstream side, which is the printing head unit 12, is formed in the ink supply device 14.

The printer 11 according to this embodiment is an ink jet type serial printer or line printer and a so-called off-carriage type printer in which the ink cartridge 13 is mounted on a printer main body. As described in FIG. 1, the printing head unit 12 connected to the ink supply device 14 through an ink supply tube 15*e* includes a head unit body 56 and a printing head 57. In the serial printer, for example, the head unit body 56 is formed by a carriage which reciprocates in a main scanning direction (right and left directions in FIG. 1), while being guided by a guiding mechanism by the power of an electric motor (carriage motor) (all of which are not shown). On the other hand, in the line printer, the head unit body 56 is fixed so as to extend in a width direction perpendicular to a sheet transporting direction, and the printing head 57 is configured such that the nozzles for each color are arranged in the whole of the maximum sheet width at a predetermined nozzle pitch. Of course, in the serial printer, the ink supply device 14 may be used in a so-called on-carriage type printer in which an ink cartridge is mounted on a carriage.

The printer 11 according to this embodiment is provided with plural the ink supply devices 14 to correspond to the number (kinds) of ink colors to be used for the printer 11. In this case, since the ink supply devices have the same configuration, one ink supply device 14 supplying one kind of ink, the printing head unit 12, and one ink cartridge 13 are shown in FIG. 1. Hereinafter, a case in which tone ink supply device 14 shown in FIG. 1 supplies the ink from the ink cartridge 13 to the printing head unit 12 will be described as an example. In the ink supply device 14 shown in FIG. 1, the cross-section of passages or valves is schematically shown to explain a principle of an ink supply mechanism. A preferable shape including the layout of the passages or the valves is described below with reference to separate drawings.

As shown in FIG. 1, in the printing head 57, plural nozzles 16 (in this embodiment, six nozzles) corresponding to the number of ink supply devices 14 are opened on a nozzle forming surface 12*a* which faces a platen (not shown). The ink supplied from each of the ink supply devices 14 to an ink passage 12*d* formed in the printing head unit 12 through the ink passage 15 is supplied to the nozzles 16 via a valve unit 17 and a defoaming unit 58 formed in the ink passage 12*d*. That is, a pressure chamber 17*a* temporarily storing the ink flowing from the ink passage 15 is formed in the valve unit 17 to communicate with the nozzles 16. Upon ejecting the ink from the nozzles 16, an amount of ink corresponding to an amount of ink consumed upon ejecting the ink flows from the ink passage 15 to the pressure chamber 17*a* appropriately in accordance with an opening or closing operation of a passage valve 17*d*. The configuration of the valve unit 17 and the defoaming unit 58 is described. The six nozzles 16 form nozzle rows such that the plural nozzles are disposed at a uniform nozzle pitch in a direction perpendicular to the surface of FIG. 1. A direction of the nozzle row (the direction perpendicular to the surface of FIG. 1) is equal to the sheet transporting direction in the serial printer and a sheet width direction in the line printer.

The printer 11 is provided with a maintenance unit 18 which performs a cleaning operation on the printing head 57 so as to solve clogging or the like of the nozzles 16 of the printing head 57. The maintenance unit 18 includes a cap 19 which comes in contact with the nozzle forming surface 12*a* of the printing head 57 to surround the nozzles 16, a sucking pump 20 which is driven upon sucking the ink from the cap 19, and a waste liquid tank 21 to which the ink sucked from the cap 19 with the drive of the sucking pump 20 is discharged as waste ink. In addition, upon performing the cleaning operation, the thickened ink or the ink mixed with bubbles is discharged from the printing head 57 to the waste liquid tank 21 by driving the sucking pump 20 in the state where the cap 19 is moved from the state shown in FIG. 1 and comes in contact with the nozzle forming surface 12*a* of the printing head 57 and by generating a negative pressure in the inner space of the cap 19. In addition, the maintenance unit 18 is disposed at a location corresponding to a home position in which the printing head unit 12 is located in non-printing in the serial printer and disposed directly below the printing head 57 in the line printer.

On the other hand, the ink cartridge 13 includes a substantial box-like case 22 serving as an ink chamber 22*a* storing ink therein. A pipe unit 23 communicating with the inside of the ink chamber 22*a* is formed downward on the lower wall of the case 22. An ink supply port 24 through which the ink can lead out is formed on the front end of the pipe unit 23. When the ink cartridge 13 is connected to the ink supply device 14, a supply needle 25 protruding from the ink supply device 14 to form the upstream end of the ink passage 15 is inserted into the ink supply port 24, an air communication hole 26 allowing the inside of the ink chamber 22*a* storing the ink to communicate to the air is formed through the upper wall of the case 22 so that the air pressure is exerted to the liquid surface of the ink stored in the ink chamber 22*a*.

Next, the configuration of the ink supply device 14 will be described in detail.

As shown in FIG. 1, the ink supply device 14 includes a first passage forming member 27 made of a resin material and serving as a base body, a second passage forming member 28 made of a resin material and laminated on the first passage forming member 27 to be assembled, and a flexible member 29 formed of a rubber plate or the like and interposed between both the passage forming members 27 and 28 upon the assembly. A film 120 is adhered onto the surface (rear surface) on the first passage forming member 27 opposite to the flexible member 29. Moreover, a protective plate 130 and a receiving plate 140 are laminated on the lower surface of the film 120. Here, concave sections 30, 31, and 32 having a circular shape in a plan view are formed at plural positions (in this embodiment, three positions) on the upper surface of the first passage forming member 27. That is, the concave sections 30 to 32 are formed parallel in order of the concave sections 30, 31, and 32 from the right side to the left side in FIG. 1.

On the other hand, concave sections 33, 34, and 35 having a circular shape in a plan view and vertically facing the concave sections 30, 31, and 32 formed on the surface of the first passage forming member 27 are formed at plural positions (in this embodiment, three positions) on the lower surface of the second passage forming member 28 laminated on the first passage forming member 27. That is, the concave sections 33 to 35 are formed parallel in order of the concave sections 33, 34, and 35 from the right side to the left side in FIG. 1. An air communication hole 35*a* communicating to the air is on the bottom of the concave section 35 formed at the most left side in the second passage forming member 28 in FIG. 1.

The flexible member 29 is interposed between the first passage forming member 27 and the second passage forming member 28 such that plural locations (three locations in this embodiment) of the flexible member 29 are vertically separated between the concave sections 30 to 32 of the first passage forming member 27 and the concave sections 33 to 35 of the second passage forming member 28. As a consequence, a portion of the flexible member 29 interposed between the concave section 30 of the first passage forming member 27 and the concave section 33 of the second passage forming member 28 functions as a sucking valve body (valve body) 36 which can elastically displace between the concave sections 30 and 33.

Likewise, a portion of the flexible member 29 interposed between the concave section 31 of the first passage forming member 27 and the concave section 34 of the second passage forming member 28 functions as a diaphragm 37 which can elastically displace between the concave sections 31 and 34. Likewise, a portion of the flexible member 29 interposed between the concave section 32 of the first passage forming member 27 and the concave section 35 of the second passage forming member 28 functions as an ejecting valve body (valve body) 38 which can elastically displace between the concave sections 32 and 35.

As shown in FIG. 1, a first passage 15*a* permitting the ink supply needle 25 protruding from the upper surface of the second passage forming member 28 to communicate with the concave section 30 of the first passage forming member 27 is formed in the first passage forming member 27 and the second passage forming member 28 so as to form a part of the ink passage 15 of the ink supply device 14. Likewise, a second passage 15*b* permitting the concave section 33 of the second passage forming member 28 to communicate with the concave section 31 of the first passage forming member 27 is formed in the first passage forming member 27, the second passage forming member 28, and the flexible member 29 so as to form a part of the ink passage 15 of the ink supply device 14. Likewise, a third passage 15*c* permitting the concave sections 31 and 32 of the first passage forming member 27 to communicate with each other is formed in the first passage forming member 27 so as to form a part of the ink passage 15 of the ink supply device 14.

Likewise, a fourth passage 15*d* permitting the concave section 32 of the first passage forming member 27 to communicate with the upper surface of the second passage forming member 28 is formed in the first passage forming member 27, the second passage forming member 28, and the flexible member 29 so as to form a part of the ink passage 15 of the ink supply device 14. An ink display port 64 which is a passage opening end of the fourth passage 15*d* opened to the upper surface of the flexible member 29 is connected to one end (upstream end) of the ink supply tube 15*e*, which forms a part of the ink passage 15, through a pipe connection port 59 attached to the end of the ink supply device 14. In addition, the other end (downstream end) of the ink supply tube 15*e* is connected to the valve unit 17 on the side of the printing head unit 12. In this embodiment, the first passage 15*a* to the fourth passage 15*d* form a liquid supply passage.

As shown in FIG. 1, the passages 15*a*, 15*b*, 15*c*, and 15*d* are in a passage passing through the rear surface of the first passage forming member 27. Therefore, through-holes 90*a* and 30*b* forming the first passage 15*a* and a groove permitting the through-holes 90*a* and 30*b* to communicate with each other, through-holes 90*b* and 31*a* forming the second passage 15*b* and a groove permitting the through-holes 90*b* and 31*a* to communicate with each other, through-holes 31*b* and 32*b* forming the third passage 15*c* and a groove permitting the through-holes 31*b* and 32*b* to each other, and through-holes 32*c* and 91*a* forming the fourth passage 15*d* and a groove permitting the through-holes 32*c* and 91*a* to communicate with each other are formed in the first passage forming member 27. In addition, parts of the passages 15*a*, 15*b*, 15*c*, and 15*d* are surrounded by a film 120 welded on the rear surface of the passage forming member 27 and the respective grooves, respectively.

As shown in FIG. 1, a portion which serves as the sucking valve body 36 of the flexible member 29 of the ink supply device 14 is provided with a through-hole 36*a* in the middle thereof and urged toward the inner bottom surface of the lower-side concave section 30 by an urging force of a coil spring 40 (an urging member) disposed in the upper-side concave section 33. In this embodiment, the concave sections 30 and 33, the sucking valve body 36, and the coil spring 40 constitute a sucking valve 41 (a sucking check valve) as a first unidirectional valve provided in the ink passage 15 so as to open and close the ink passage 15. The sucking valve 41 includes a valve chamber 41*a* communicating with an opening (an ink sucking port) on the downstream end of the first passage 15*a* and a valve chamber 41*b* communicating with an opening (an ink discharging port) on the upstream end of the second passage 15*b*. The valve chamber 41*a* is formed as a spatial area with a ring shape surrounded by the concave section 30 and the sucking valve body 36 in a valve closed state where the middle of the sucking valve body 36 comes in contact with a valve seat 30*a* in the middle of the bottom surface of the concave section 30. With such a configuration, during the openness and closeness of the sucking valve 41, the ink pressure of the valve chambers 41*a* and 41*b* is applied to the sucking valve body 36 with an area sufficiently broader than the opening area of the passages 15*a* and 15*b*, and the sucking valve 41 can be opened and closed with good sensitivity even by a relatively small differential pressure between the valve chambers 41*a* and 41*b*. That is, the sucking valve 41 can be opened and closed with good sensitivity, compared to a case of using the sucking valve 41 having a structure in which the coil spring 40 urges the sucking valve body 36 in a valve closing direction.

Likewise, a portion which becomes a diaphragm 37 of the flexible member 29 of the ink supply device 14 is urged toward the inner bottom surface of the lower-side concave section 31 by the urging force of a coil spring 42 (an urging member) disposed in the upper-side concave section 34. In this embodiment, the concave sections 31 and 34, the diaphragm 37, and the coil spring 42 constitute a pulsation type pump 43. A volume variable spatial area surrounded by the diaphragm 37 and the lower-side concave section 31 functions as a pump chamber 43*a* in the pump 43.

Likewise, a portion which becomes the ejecting valve body 38 of the flexible member 29 of the ink supply device 14 is urged toward the inner bottom surface of the lower-side concave section 32 by the urging force of a coil spring 44 (an urging member) disposed in the upper-side concave section 35. In this embodiment, the concave sections 32 and 35, the ejecting valve body 38, and the coil spring 44 constitute an ejecting valve 45 (an ejecting check valve) as a second unidirectional valve provided in the ink passage 15 on the more downstream side than the pump 43 so as to open and close the ink passage 15. The ejecting valve 45 includes a valve chamber 45*a* (an ink chamber) communicating with an opening (an ink inflow port) on the downstream end of the third passage 15*c* and a valve chamber 45*b* (an air chamber) opened to the air through an air communication hole 35*a*. The valve chamber 45*a* is formed as a spatial area with a ring shape surrounded by the concave section 32 and the ejecting valve body 38 in a valve closed state where the middle of the ejecting valve body 38 comes in contact with a valve seat 32*a* in the middle of the bottom surface of the concave section 32. With such a configuration, during the openness and closeness of the ejecting valve 45, the ink pressure of the valve chamber 45*a* is applied to the ejecting valve body 38 with an area sufficiently broader than the opening area of the third passage 15*c*, and the ejecting valve 45 can be opened and closed with good sensitivity even by a relatively small variation in pressure between the valve chamber 45*a*. That is, the ejecting valve 45 can be opened and closed with good sensitivity in comparison to using the ejecting valve 45 having a structure in which the coil spring 44 urges the ejecting valve body 38 in the valve closing direction.

As shown in FIG. 1, a negative pressure generating device 47 constituted by the sucking pump or the like and an air opening mechanism 48 are connected to the concave section 34 of the second passage forming member 28 via an air passage 46 having a shape diverged in both directions. The negative pressure generating device 47 is driven by a driving force, which is transferred via a one-way clutch (not shown) when a driving motor 49 capable of forward and backward rotation is driven to rotate forward, to generate negative pressure. Likewise, the negative pressure generating device can also generate negative pressure in the concave section 34 of the second passage forming member 28 connected via the air passage 46. Accordingly, the volume variable spatial area surrounded by the concave section 34 of the second passage forming member 28 and the diaphragm 37 is configured to function as a negative pressure chamber 43*b* which becomes a negative pressure state with the drive of the negative pressure generating device 47.

On the other hand, the air opening mechanism 48 has a configuration in which an air opening valve 53 formed by adding a sealing member 52 to the side of an air opening hole 50 in a box 51 provided with the air opening hole 50 is accommodated and the air opening valve 53 typically urges the air opening hole 50 by the urging force of the coil spring 54 in the valve closing direction in which the air opening hole 50 is sealed. In addition, the air opening mechanism 48 is configured such that a cam mechanism 55 operating on the basis of the driving force transferred via the one-way clutch (not shown) operates when the driving motor 49 is driven to rotate backward and the air opening valve 53 is displaced against the urging force of the coil spring 54 in a valve opening direction by the operation of the cam mechanism 55. That is, the air opening mechanism 48 opens the inside of the negative pressure chamber 43*b* to the air to release a negative pressure state by allowing the air opening valve 53 to perform a valve opening operation when the negative pressure chamber 43*b* connected via the air passage 46 becomes the negative pressure state.

One negative pressure generating device 47, one air opening mechanism 48, and one driving motor 49 driving the negative pressure generating device and the air opening mechanism are provided and shared by the plural ink supply devices 14. That is, an air passage pipe 46*a* forming the air passage 46 which connects between the negative pressure generating device 47, the air opening mechanism 48, and each ink supply device 14 is connected to an air passage 46*b* formed in each ink supply device 14. The air passage 46*b* is diverged in the midway thereof and the front end of the diverged passage is connected to the negative pressure chamber 43*b* of the pump 43 of each ink supply device 14. With such a configuration, since the ink supply devices 14 can be driven just by providing one negative pressure generating device 47, one air opening mechanism 48, and one driving motor 49 in the plural ink supply devices 14, it is possible to reduce the size of the printer 11. The air passage 46*b* connected to the pressure chamber 43*b* of each pump 43 is opened to the upper surface of the flexible member 29 via the rear surface of the first passage forming member 27 and forms a negative pressure lead-out port 65. The negative pressure lead-out port 65 is connected to one end (the upstream end) of an air supply tube 46*c* through the pipe connection port 59. In addition, the other end (the downstream end) of the air supply tube 46*c* is connected to the printing head unit 12 and negative pressure can be introduced to the defoaming unit 58.

Here, the configurations and functions of the valve unit 17 and the defoaming unit 58 provided within the printing head unit 12 will be described. As shown in FIG. 1, an air chamber 12*c* communicating to the air via the air communication hole 12*b* is provided within the printing head unit 12. The valve unit 17 includes the pressure chamber 17*a* which temporarily stores the ink flowing to the ink passage 12*d* formed in the printing head unit 12, a partition wall 17*b* partitioning the pressure chamber 17*a* and the air chamber 12*c*, and a passage valve 17*d* which is urged in the valve closing direction by a spring 17*c* to come in contact with the partition wall 17*b*. The partition wall 17*b* is formed of a film (or a sheet) made of a flexible material (for example, synthetic resin or rubber), and a metal piece (for example, a metal piece having a pectinate shape, for example) (not shown) having a portion displaceable together with, for example, a film is disposed at the contact position of the passage valve 17*d*. In addition, an ink storing chamber 12*e* which temporarily stores ink is formed in the ink passage 12*d* formed from the pressure chamber 17*a* to the nozzles 16.

When the ink from the nozzles 16 is ejected and consumed, the actual pressure of the pressure chamber 17*a* is depressurized by a decrease in the ink and the partition wall 17*b* is bent and deformed toward the pressure chamber 17*a* on the basis of a differential pressure between the depressurized pressure chamber 17*a* and the air chamber 12*c*, so that the passage valve 17*d* is moved to a valve opened position against the urging force of the spring 17*c* and the ink flows to the pressure chamber 17*a*. When the ink flows into the pressure chamber 17*a* and the actual pressure of the pressure chamber is increased, the passage valve 17*d* is again moved to a valve closed position since the actual pressure exceeds the urging force of the spring 17*c*. When the passage valve 17*d* of the valve unit 17 opens and closes the passage in accordance with the consumption of the ink, the ink is configured to appropriately flow from the ink supply tube 15*e* to the printing head unit 12.

The defoaming unit 58 includes a depressurizing chamber 58*a* communicating with the air supply tube 46*c* via the negative pressure passage 12*f* formed in the printing head unit 12, a partition wall 58*b* partitioning the depressurizing chamber 58*a* and the air chamber 12*c*, a passage valve 58*d* urged by the spring 58*c* to come in contact with the partition wall 58*b*, and a negative pressure chamber 58*e* communicating with the depressurizing chamber 58*a* upon valve openness of the passage valve 58*d*. The two partition walls 17*b* and 58*b* are formed of a common film (or a sheet), and a metal piece (not shown) having a piece displaceable together with the contact position of the passage valve 58*d* is disposed in the partition wall 58*b*.

The negative pressure chamber 58*e* and the ink storing chamber 12*e* are partitioned through a partition wall 58*f* formed of a synthetic resin material having a gas permeable property. When a negative pressure is introduced to the depressurizing chamber 58*a* via the air supply tube 46*c* and the negative pressure passage 12*f* upon the sucking drive of the pump 43, the partition wall 58*b* is bent and deformed toward the depressurizing chamber 58*a* on the basis of the differential pressure between the depressurizing chamber 58*a* and the air chamber 12*c* and the negative pressure of the depressurizing chamber 58*a* is introduced to the negative pressure chamber 58*e* by moving the passage valve 58*d* to the valve opened position against the urging force of the spring 58*c*. On the other hand, the depressurizing chamber 58*a* is opened to the air through the air supply tube 46*c* and the negative pressure passage 12*f* upon the ejecting drive of the pump 43. At this time, however, since the passage valve 58*d* is maintained at the valve closed position by the urging force of the spring 58*c*, the negative pressure chamber 58*e* maintains the negative pressure state. That is, after the sucking drive of the pump 43 is performed at least one time after the activation of the printer 11, the negative pressure chamber 58*e* maintains a negative pressure state to some extent or more, and bubbles or dissolved air in the ink stored in the ink storing chamber 12*e* permeate through the partition wall 58*f* to be collected to the side of the negative pressure chamber 58*e*. In this way, the defoaming unit 58 defoams the ink.

Figure 2A:
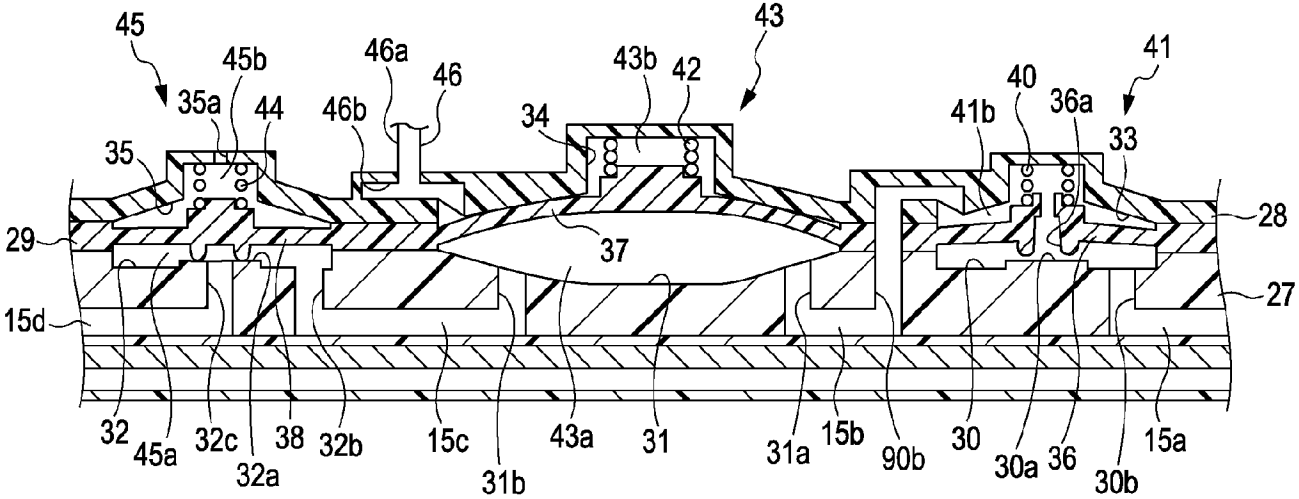
FIG. 2A is a schematic sectional view illustrating an ink supply device upon suction drive and FIG. 2B is a schematic sectional view illustrating the ink supply device upon ejection drive.
Figure 2B:
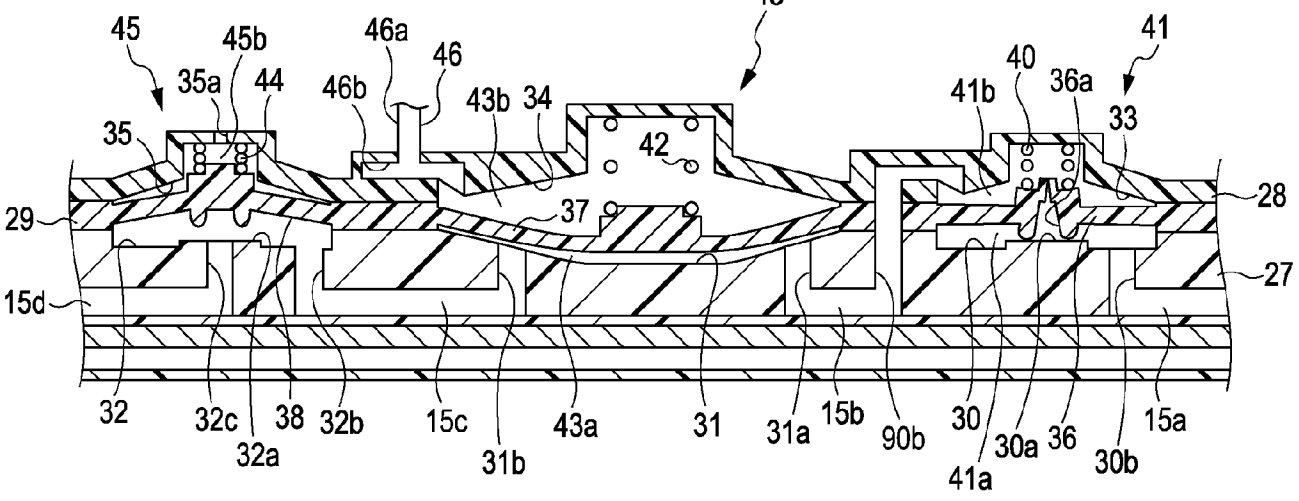

Next, the operation of the printer 11 having the above-described configuration will be described particularly focusing the operation of the ink supply device 14. FIG. 2A is a diagram illustrating the cross-section of the ink supply device upon the sucking drive and FIG. 2B is a diagram illustrating the cross-section of the ink supply device upon the ejecting drive.

First, it is assumed that the state shown in FIG. 1 shows the state immediately after an old ink cartridge is replaced by a new ink cartridge, and the sucking valve body 36 of the sucking valve 41, the diaphragm 37 of the pump 43, and the ejecting valve body 38 of the ejecting valve 45 are pressed down and attached onto the inner bottom surface of the lower-side concave sections 30, 31, and 32 by the urging forces of the coil springs 40, 42, and 44, respectively. In addition, it is assumed that the air opening mechanism 48 is in the valve closed state where the air opening valve 53 seals the air opening hole 50.

When the ink supply device 14 supplies the ink from the ink cartridge 13 to the printing head unit 12 in the state shown in FIG. 1, the driving motor 49 is first driven to rotate forward to drive the pump 43. Then, the negative pressure generating device 47 generates the negative pressure and the negative pressure chamber 43*b* of the ink supply device 14 connected to the negative pressure generating device 47 via the air passage 46 becomes the negative pressure state. Accordingly, the diaphragm 37 of the pump 43 is elastically deformed (displaced) toward the negative pressure chamber 43*b* against the urging force of the coil spring 42 to decrease the volume of the negative pressure chamber 43*b* (see FIG. 2A). Then, the volume of the pump chamber 43*a* partitioned with the negative pressure chamber 43*b* through the diaphragm 37 is conversely increased with the decrease in the volume of the negative pressure chamber 43*b*.

That is, the pump 43 displaces the diaphragm 37 in a direction increasing the volume of the pump chamber 43*a* to perform the sucking drive. Specifically, the diaphragm 37 is displaced from a bottom dead point shown in FIG. 1 to a top dead point shown in FIG. 2A. Accordingly, the pump chamber 43*a* becomes a negative pressure state, the negative pressure is applied to the upper-side valve chamber 41*b* of the sucking valve 41 through the second passage 15*b*, and the sucking valve body 36 is elastically deformed (displace) toward the upper side (that is, in the valve opening direction) against the urging force of the coil spring 40 on the basis of the pressure difference with the ink pressure of the lower-side valve chamber 41*a*. As a consequence, the first passage 15*a* and the second passage 15*b* becomes a communication state one another through the through-hole 36*a* of the sucking valve body 36, and the ink is sucked from the ink cartridge 13 to the pump chamber 43*a* via the first passage 15*a*, the valve chamber 41*a*, the through-hole 36*a*, the valve chamber 41*b*, and the second passage 15*b*.

On the other hand, upon the sucking drive of the pump 43, the negative pressure of the pump chamber 43*a* is also applied to the more downstream side of the ink passage 15 than the pump chamber 43*a*, that is, the third passage 15*c* through the third passage 15*c*. However, the lower-side valve chamber 45*a* of the ejecting valve 45 communicating with the downstream side of the third passage 15*c* is configured so as not to become the valve opened state, as long as the ejecting valve body 38 is urged in the valve closing direction by the coil spring 44 and an ink ejection pressure of a predetermined positive pressure (for example, a pressure of 13 kPa or more) is not applied from the upstream side of the third passage 15*c* to the ejecting valve body 38 by the ejecting drive of the pump 43 in the valve closed state. Accordingly, in this case, the ejecting valve body 38 of the ejecting valve 45 maintains the valve closed state, since the negative pressure is applied.

Next, the driving motor 49 is driven to rotate backward in the state shown in FIG. 2A. Then, the air opening valve 53 performs the valve opening operation against the urging force of the coil spring 54 by the operation of the cam mechanism 55 of the air opening mechanism 48 and opens the negative pressure chamber 43*b*, which has been in the negative pressure state, to the air. Accordingly, the diaphragm 37 of the pump 43 is elastically deformed (displaced) toward the lower side (that is, the inner bottom surface of the pump chamber 43*a*) and the volume of the negative pressure chamber 43*b* is increased by the urging force of the coil spring 42 (see FIG. 2B). On the contrary, the volume of the pump chamber 43*a* of the pump 43 partitioned with the negative pressure chamber 43*b* through the diaphragm 37 decreases with the increase in the volume of the negative pressure chamber 43*b*.

That is, the pump 43 displaces the diaphragm 37 in a direction decreasing the volume of the pump chamber 43*a* to perform the ejecting drive. Specifically, as shown in FIG. 2B, the diaphragm 37 is displaced from the top dead point to the bottom dead point, and the ink which has been sucked in the pump chamber 43*a* is pressurized at a predetermined pressure (for example, about a pressure of 30 kPa). Accordingly, the ink in the pump chamber 43*a* is ejected, the ejection pressure is applied to the upper-side valve chamber 41*b* of the sucking valve 41 via the second passage 15*b* on the more upstream side than the pump chamber 43*a*, and the ejection pressure elastically deforms (displaces) the sucking valve body 36 toward the lower side (that is, the valve closing direction) in cooperation with the urging force of the coil spring 40. As a consequence, the first passage 15*a* and the second passage 15*b* become a non-communication state by a valve closing operation of the sucking valve body 36, the suction of the ink from the ink cartridge 13 to the pump chamber 43*a* via the sucking valve 41 stops, and the ink ejected from the pump chamber 43*a* with the ejecting drive of the pump 43 is regulated so as not to flow backward to the ink cartridge 13 via the sucking valve 41.

On the other hand, upon the ejecting drive of the pump 43, the pressure (for example, about a pressure of 30 kPa) of the ink ejected from the pump chamber 43*a* is also applied to the downstream side of the ink passage 15 via the third passage 15*c*. Accordingly, the ejecting pressure of the pump 43 permits the ejecting valve body 38 in the valve closed state to perform the valve opening operation, so that the third passage 15*c* and the fourth passage 15*d* communicate with each other through the lower-side valve chamber 45*a* in the ejecting valve 45. As a consequence, the pressurized ink from the pump chamber 43*a* is supplied to the valve unit 17 via the third passage 15*c*, the valve chamber 45*a*, the fourth passage 15*d*, and the ink supply tube 15*e*. In addition, the urging force of the coil spring 44 in the ejecting valve 45 is set to about 13 kPa, for example, so that the ejecting valve body 38 is elastically deformed toward the upper side by the ejection pressure of the ink, when the ink flows to the valve chamber 45*a* of the ejecting valve 45 upon the ejecting drive of the pump 43.

Thereafter, the ejection pressure of the ink pressurized by the diaphragm 37 and ejected from the pump chamber 43*a* remains in balance in the respective passage areas (which include the pump chamber 43*a* and the valve chamber 45*a* of the ejecting valve 45) on the downstream side including the valve chamber 41*b* of the sucking valve 41 in the ink passage 15. Thereafter, when the ink is ejected from the printing head 57 to a target (not shown), an amount of the ink corresponding to the amount of ink consumed upon the ejection of the ink is supplied from the ink passage 15 to the printing head unit 12 upon the valve openness of the valve unit 17. Accordingly, as the ink is consumed in the downstream side (the printing head unit 12), the amount of ink corresponding to the amount of ink consumed is supplied in the pressurized state to the printing head unit 12 (on the downstream side) on the basis of the pressurizing force of the diaphragm 37 urged in a direction decreasing the volume of the pump chamber 43*a* by the urging force of the coil spring 42.

As a consequence, the volume of the pump chamber 43*a* and the volume of the valve chamber 45*a* of the ejecting valve 45 gradually decrease. Finally, the diaphragm 37 is displaced up to the vicinity of the bottom dead point and the ejecting valve body 38 is displaced up to the vicinity of the valve closed position at which the fourth passage 15*d* is closed. In this embodiment, the diaphragm 37 is pressurized at this time point and the ejection pressure of the ink ejected from the pump chamber 43*a* becomes about 13 kPa.

Then, the driving motor 49 is again driven to rotate forward, the air opening valve 53 is displaced in the air opening mechanism 48 to the valve closed position at which the air opening hole 50 is closed. In addition, the negative pressure generating device 47 generates the negative pressure, so that the negative pressure chamber 43*b* becomes the negative pressure state and the diaphragm 37 is elastically deformed (displaced) toward the negative pressure chamber 43*b* against the urging force of the coil spring 42. That is, the pump 43 again starts the sucking drive. As a consequence, since the diaphragm 37 is displaced to the top dead point to increase the volume of the pump chamber 43*a* and the pump chamber 43*a* becomes the negative pressure state, the sucking valve body 36 is elastically deformed (displaced) in the valve opening direction. Accordingly, the first passage 15*a* and the second passage 15*b* becomes the communication state through the through-hole 36*a* of the sucking valve body 36, and the ink is sucked from the ink cartridge 13 to the pump chamber 43*a*. Thereafter, the ejecting drive of the pump 43 is performed and the pressurized ink is supplied from the pump chamber 43*a* to the printing head unit 12 via the ink passage area on the downstream side.

Next, an example of an ink supply system in which the plural ink supply devices 14 having the above-described configuration are made into one unit will be described with reference to FIGS. 3 to 20.

Figure 3:
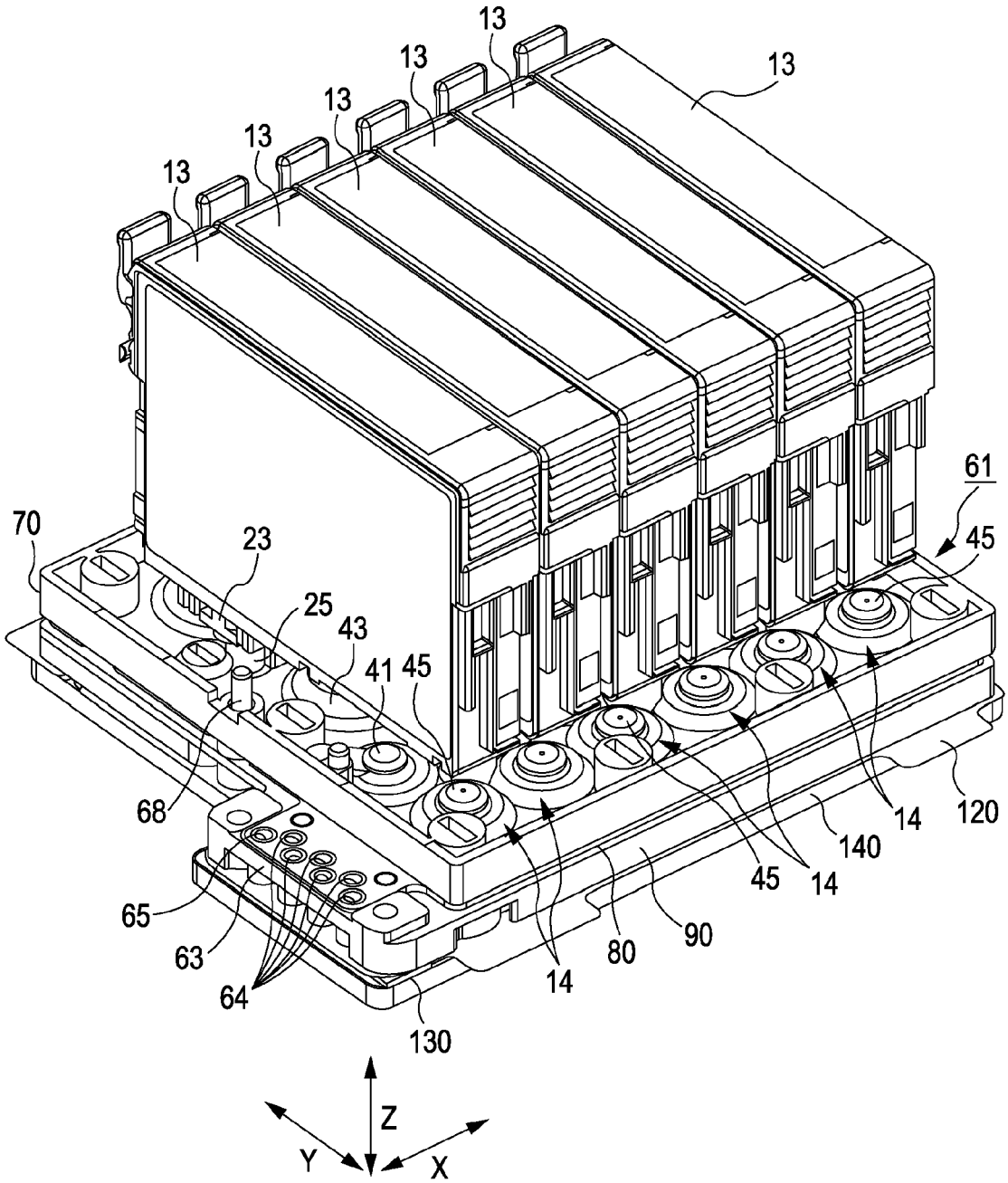
FIG. 3 is a perspective view illustrating an ink supply system mounted with ink cartridges.
Figure 4:
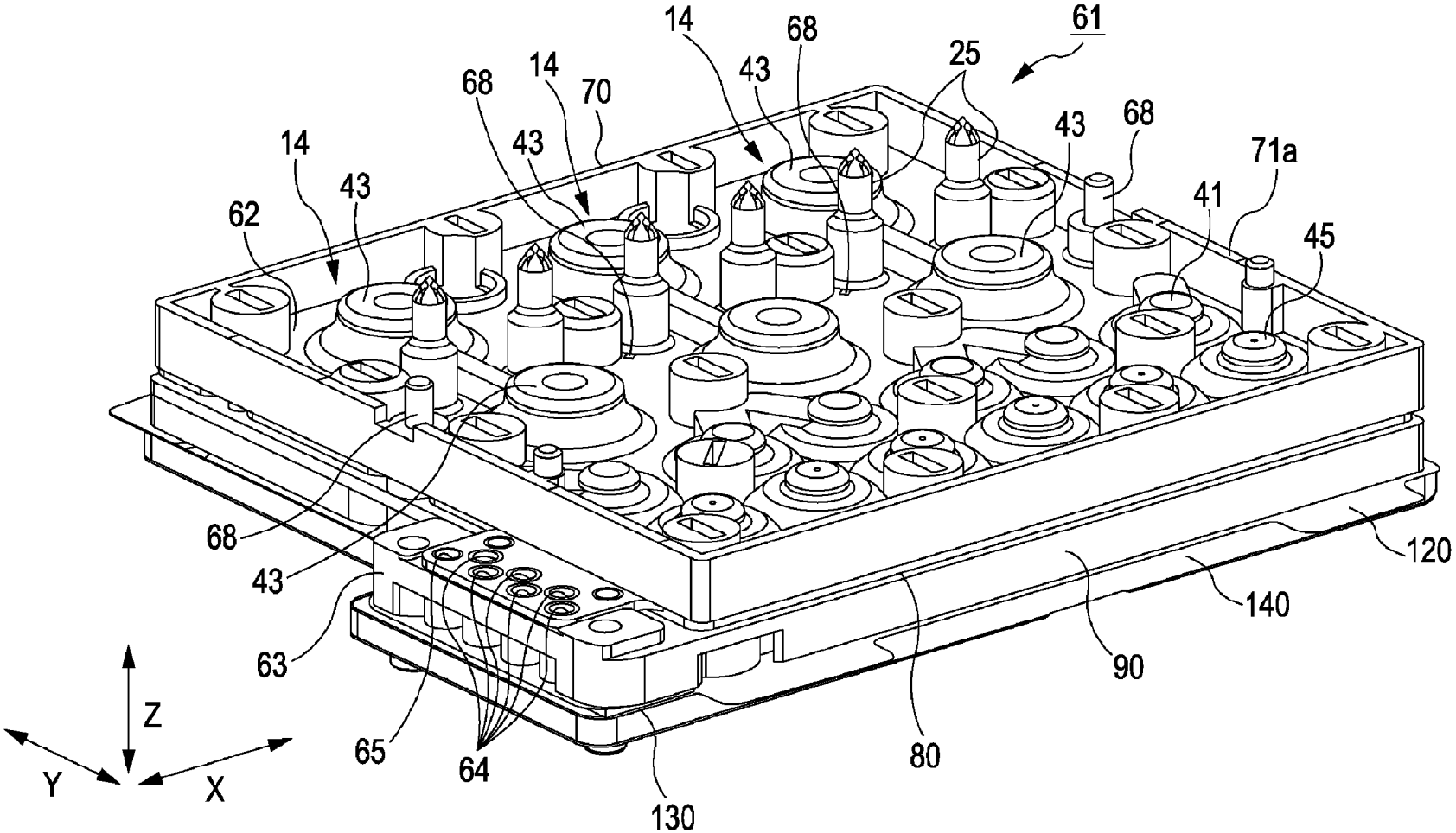
FIG. 4 is a perspective view illustrating the ink supply system.

FIG. 3 is a perspective view illustrating the ink supply system mounted with plural ink cartridges. FIG. 4 is a perspective view illustrating the ink supply system when the ink cartridges are not mounted. Hereinafter, in the following description, a direction parallel to an arrangement direction of the ink supply needles 25 is denoted by an X direction, a direction perpendicular to the arrangement direction of the ink supply needles is denoted by a Y direction, and an upper direction which is perpendicular to the XY plane and a protruding direction of the ink supply needles 25 is denoted by a Z direction.

An ink supply system 61 which is a liquid supply device shown in FIGS. 3 and 4 is disposed at a predetermined position within the printer 11 and functions as a cartridge holder on which the ink cartridges 13 are mounted. The ink supply system 61 has a lamination structure with a substantially rectangular plate. The ink supply needles 25 (see FIG. 4) arranged in plural rows (in this embodiment, six rows) are disposed in one row in the x direction on the upper surface of the ink supply system so as to protrude perpendicularly (in the Z direction) from the upper surface thereof. The plural (in this embodiment, six) ink cartridges 13 are mounted on the upper side of the ink supply system 61 so as to be nearly adjacent to each other in one row in the X direction by inserting the ink supply needles 25 into the ink supply ports 24 (see FIG. 1) of the pipe unit 23, respectively.

The ink supply system 61 according to this embodiment has a structure in which the six ink supply devices 14 capable of individually supplying six colors such as cyan, magenta, yellow, light cyan, light yellow, and black respectively stored in the six ink cartridges 13 are made into one unit. That is, the ink supply system 61 is capable of using the lamination structure in which plural constituent members having a plate shape are laminated by disposing six pumps 43 (supply pumps), six sucking valves 41 (first unidirectional valves), and six ejecting valves 45 (second unidirectional valves) respectively forming the six ink supply devices 14 on the same plane. In addition, the ink supply system 61 made into one component (one unit) is realized by configuring at least one of the plural constituent members to a single (common) passage forming member and laminating the other constituent members (where the single passage forming member is not necessarily required and the constituent members may be formed in each of the ink supply device). In this embodiment, however, as described below, all the plural constituent members laminated to form the ink supply system 61 are formed as the single forming members that are common to the six ink supply devices 14. The number of the ink supply devices 14 made into one unit as the ink supply system 61 is not limited to six. For example, plural ink supply devices such as two to ten ink supply devices or ten or more ink supply devices may be used. It is not necessary to match with the number of colors (the number of ink cartridges) of the printer 11. For example, two ink supply systems each formed by making three ink supply devices 14 into one unit may be mounted in the printer 11. That is, the plural ink supply systems may be mounted in one printer 11.

As shown in FIGS. 3 and 4, the ink supply system 61 includes a main body 62 which has a rectangular plate shape and includes plural (for example, six) pump 43, sucking valves 41, and ejecting valves 45 corresponding to the number of colors and a pipe connection section 63 which has a plate shape horizontally extending from one end of the main body 62.

As shown in FIG. 4, the main body 62 has the six ink supply needles 25 which protrude from the upper surface of the main body vertically (in the Z direction) so as to be arranged in one row in the X direction therein, the six pumps 43 which are arranged in two rows in the X direction so that each three pumps are arranged in one row, the six sucking valves 41 which are arranged in one row in the X direction, and the six ejecting valves 45 which are arranged in one row in the X direction.

As shown in FIGS. 3 and 4, six ink discharging ports 64 and one negative pressure lead-out port 65 are opened on the upper surface of the pipe connection section 63. The six ink discharging ports 64 each serve as a discharging port which pressurizes and supplies the ink sucked from each ink cartridge 13 by each pump 43 to the outside with a predetermined ejection pressure. The one negative pressure lead-out port 65 serves as a lead-out port which leads out the negative pressure introduced into the ink supply system 61 from the negative pressure generating device 47 (see FIG. 1) to permit the pulsation type pump 43 to perform the sucking drive for another usage (in this embodiment, the defoaming unit 58).

The pipe connection tool 59 (see FIG. 1), which is fixed to one end of a flexible pipe plate in which the six ink supply tubes 15*e* and the one air supply tube 46*c* (see FIG. 1) connected to the printing head unit 12 are bundled onto a flexible plate, is connected to the pipe connection section 63. The ink discharged from each of the ink discharging ports 64 is pressurized and supplied to each of the valve units 17 formed in the printing head unit 12 via each of the ink supply tubes 15*e*. On the other hand, the negative pressure led out from the negative pressure lead-out port 65 upon the sucking drive of the pump 43 is supplied to the defoaming unit 58 formed in the printing head unit 12 via the air supply tube 46*c* (see FIG. 1). In the ink supply system 61 according to this embodiment, a connection tube 106 (see FIG. 16) connected to the air passage pipe 46*a* (see FIG. 1) protrudes from the rear surface. In addition, the air passage 46*b* formed within the ink supply system 61 passes through the inside of a path formed from the connection tube 106 to the negative pressure lead-out port 65 via the negative pressure chamber 43*b* of each pump 43.

The ink supply system 61 has the lamination structure in which the six members 70, 80, 90, 120, 130, and 140 are laminated. The upper five members 70, 80, 90, 120, and 130 forming the ink supply system 61 are fixed by being fastened at plural positions (in this embodiment, nineteen positions) in a pressurized state by a predetermined fastening force in the lamination direction from the upper side. On the lower side of the lamination structure in which the five members 70, 80, 90, 120, and 130 are locked and fixed in the laminated state, the receiving plate 140 is fixed to the lowermost layer of the lamination structure by fastening two screws 68 in the lamination direction from the lower side.

Figure 5:
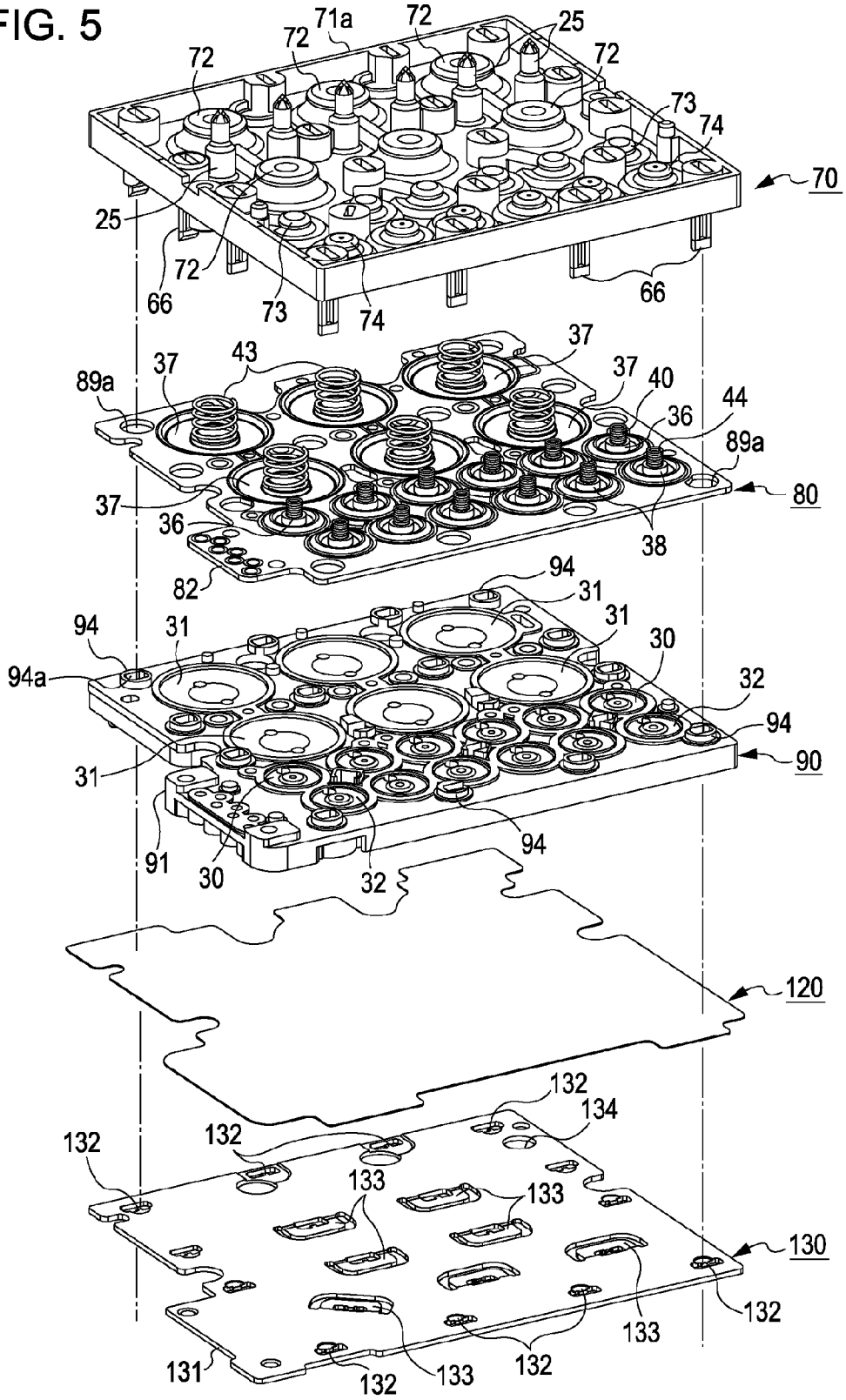
FIG. 5 is an exploded perspective view illustrating the ink supply system when viewed from the upper side.
Figure 6:
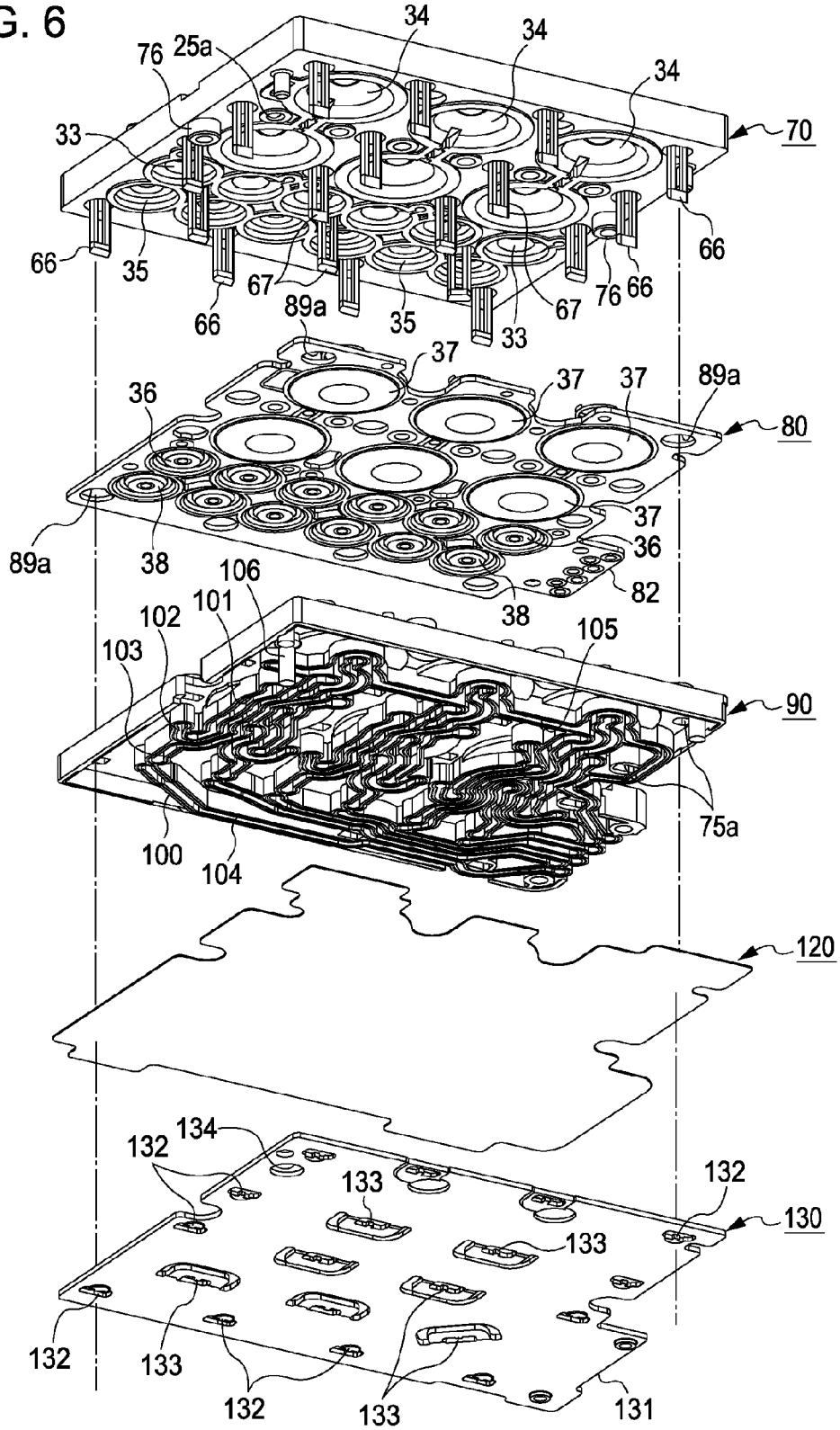
FIG. 6 is an exploded perspective view illustrating the ink supply system when viewed from the lower side.

Hereinafter, the detailed configuration of the ink supply system 61 will be described. FIG. 5 is an exploded perspective view illustrating the ink supply system 61 when viewed from the upper side. FIG. 6 is an exploded perspective view illustrating the ink supply system 61 when viewed from the lower side. In FIGS. 5 and 6, the protective plate 130 is not shown. As shown in FIGS. 5 and 6, the ink supply system 61 includes the cover 70 which has a rectangular plate shape and corresponds to the second passage forming member 28, the diaphragm forming member 80 which corresponds to the flexible member 29, the passage forming plate 90 which corresponds to the first passage forming member 27, the film 120, the protective plate 130, and the receiving plate 140 in this order from the upper side. The film 120 is welded in advance on the rear surface of the passage forming plate 90 before the assembly. Upon the assembly, the coil springs 40, 42, and 44 respectively corresponding to the upper sides of the sucking valve body 36, the diaphragm 37, and the ejecting valve body 38 incorporated into the diaphragm forming member 80 are set. Then, the upper five members 70, 80, 90, 120, and 130 having the rectangular plate shape are fixed in a vertical direction (a lamination direction) of FIGS. 5 and 6 in the pressurized state by a predetermined force by inserting plural locking hooks 66 (in this embodiment, nineteen locking hooks) vertically extending from plural positions of the rear surface of the cover 70 into the laminated members 80, 90, 120, and 130 and locking plural lockable members 132 and 133 formed on the protective plate 130 disposed in the lowermost layer. In this way, it is possible to assemble the lamination structure in which the cover 70, the diaphragm forming member 80, the passage forming plate 90, the film 120, and the protective plate 130 are fixed in the laminated state with the coil springs 40, 42, and 44 accommodated between the cover 70 and the diaphragm forming member 80 in a compressed state. The ink supply system 61 shown in FIG. 4 is formed by disposing the receiving plate 140 (see FIGS. 3 and 4) on the bottom surface of the lamination structure in which the members 70, 80, 90, 120, and 130 are fixed and fastening the two screws 68 from the lower side to fix the receiving plate 140 on the lowermost layer.

Here, the cover 70, the passage forming plate 90, and the receiving plate 140 are made of a plastic material and formed in a predetermined rectangular plate shape by metal molding (ejection molding, etc.), for example, using a synthetic resin material. The diaphragm forming member 80 is made of elastomer or rubber and formed in a predetermined rectangular plate shape by metal molding (ejection molding, etc.), for example. The film 120 is formed of a laminated film which has a surface made of a synthetic resin material which can be welded with the synthetic resin material of the passage forming plate 90 and is cut in a predetermined substantially rectangular shape. The protective plate 130 is made of a metal material and is punched in a predetermined rectangular plate shape to form the plural lockable members 132 and plural holes 134.

The cover 70, the diaphragm forming member 80, and the passage forming plate 90 are constituent members which are laminated in the state where the coil springs 40, 42, and 44 are accommodated and in which the six pumps 43, the six sucking valves 41, and the six ejecting valves 45 are disposed on the same plane. The cover 70 is also used as a board provided with the ink supply needles 25.

Plural grooves 101 to 105 (see FIGS. 15 and 16) for forming the first passage 15*a*, the second passage 15*b*, the third passage 15*c*, the fourth passage 15*d*, and the air passage 46*b* (see FIG. 1 and FIGS. 2A and 2B) are formed on the rear surface of the passage forming plate 90. By welding the film 120 on the rear surface of the passage forming plate 90, the passages 15*a*, 15*b*, 15*c*, and 15*d* and the air passage 46*b* connecting between the ink supply needles 25, the sucking valves 41, the pumps 43, and the ejecting valves 45 are formed on the rear surface of the passage forming plate 90.

The reason to use the sucking valves 41, the ejecting valves 45, and the coil springs 40 and 44 is to ensure to what extent the check valves (the unidirectional valve) have closed. For example, when the valve closeness of the ejecting valve 45 has not closed completely and thus the ink leaks, an amount of ink flowing in the ink passage of each color becomes irregular. Moreover, when the valve closeness of the sucking valve 41 is incomplete and thus the ink leaks, the ink flowing backward comes out unnecessarily from the ink supply needle 25 in a case where the ink cartridge 13 is detached, for example. In this way, when the ink is unnecessarily consumed, a difference in the amounts of ink of respective colors consumed occurs. For this reason, the check valves of the sucking valve body 36 and the ejecting valve body 38 require a configuration for preventing the ink from leaking. In this embodiment, the urging coil springs 40 and 44 are provided in addition to the diaphragm type valve bodies 36 and 38. Of course, when this configuration is used, it is necessary to broaden the diaphragm areas of the valve bodies 36 and 38 so as to open the valves against the urging force of the coil springs 40 and 44, and the valves 41 and 45 are required to have the broad disposition area.

In this embodiment, the check valve structure requiring this broad disposition area is used to ensure reliability, but other structures may be realized to save a space. For example, almost all of the pumps 43 and the valves 41 and 45 are disposed within a projection range of the ink cartridges 13 before the ink cartridges are mounted on the ink supply system 61, and the ink supply system 61 is formed in a substantially same plane size as that of the projected area.

In the ink supply system 61 according to this embodiment, the pumps 43 and the valves 41 and 45 are disposed very precisely within a predetermined rectangular area by arranging the six pumps 43 having a relatively large diameter in two rows so as to be nearly adjacent to each other and arranging the six sucking valves 41 and the six ejecting valves 45 having a relatively small diameter, which is the substantially half of the diameter of the pump 43, in one row so as to be nearly adjacent to each other in the adjacent area of the pumps. In addition, each of the ink supply needles 25 is disposed in the gap between the rows of the pumps 43. With such a layout, the ink supply system 61 can be configured so as to have a small thickness and a small plane size. However, when the precise layout is used, the ink supply needle 25 and the sucking valve 41, the sucking valve 41 and the pump 43, and the pump 43 and the ejecting valve 45 are relatively distant from each other, respectively. Moreover, the passage lengths of the first passage 15*a*, the second passage 15*b*, the third passage 15*c*, the fourth passage 15*d*, and the air passage 46*b* may be relatively long. Accordingly, by disposing the first passage 15*a*, the second passage 15*b*, the third passage 15*c*, the fourth passage 15*d*, and the air passage 46*b* on the rear surface of the passage forming plate 90, the effective layout of the lengthened passages 15*a*, 15*b*, 15*c*, 15*d*, and 46*b* can be achieved without sacrificing the precise layout (that is, the reduction in the plane size) of the pumps 43 and the valves 41 and 45.

Next, the configuration of each member of the ink supply system 61 will be described.

Figure 7:
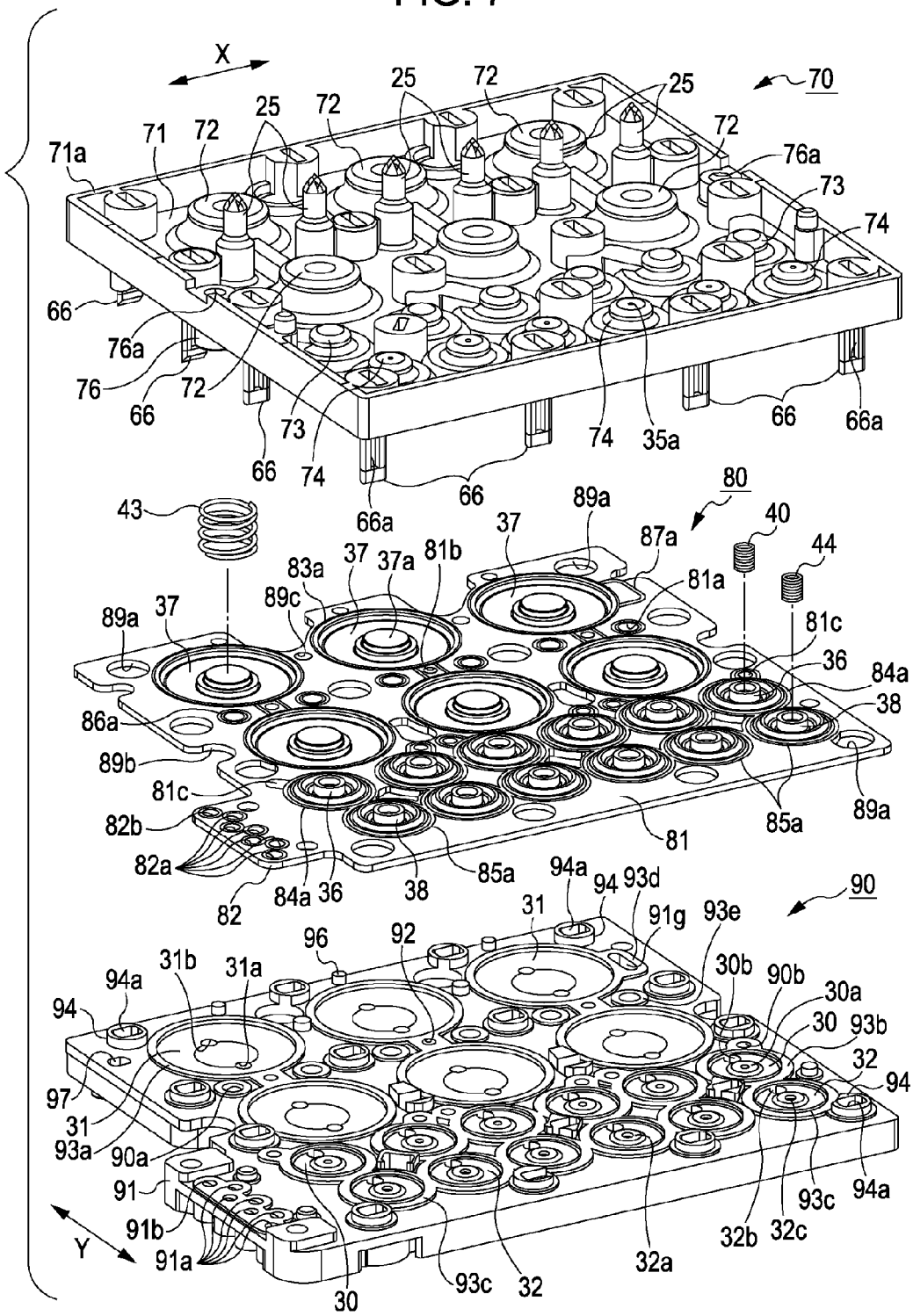
FIG. 7 is an exploded perspective view illustrating a cover, a diaphragm forming member, and a passage forming plate.
Figure 8:
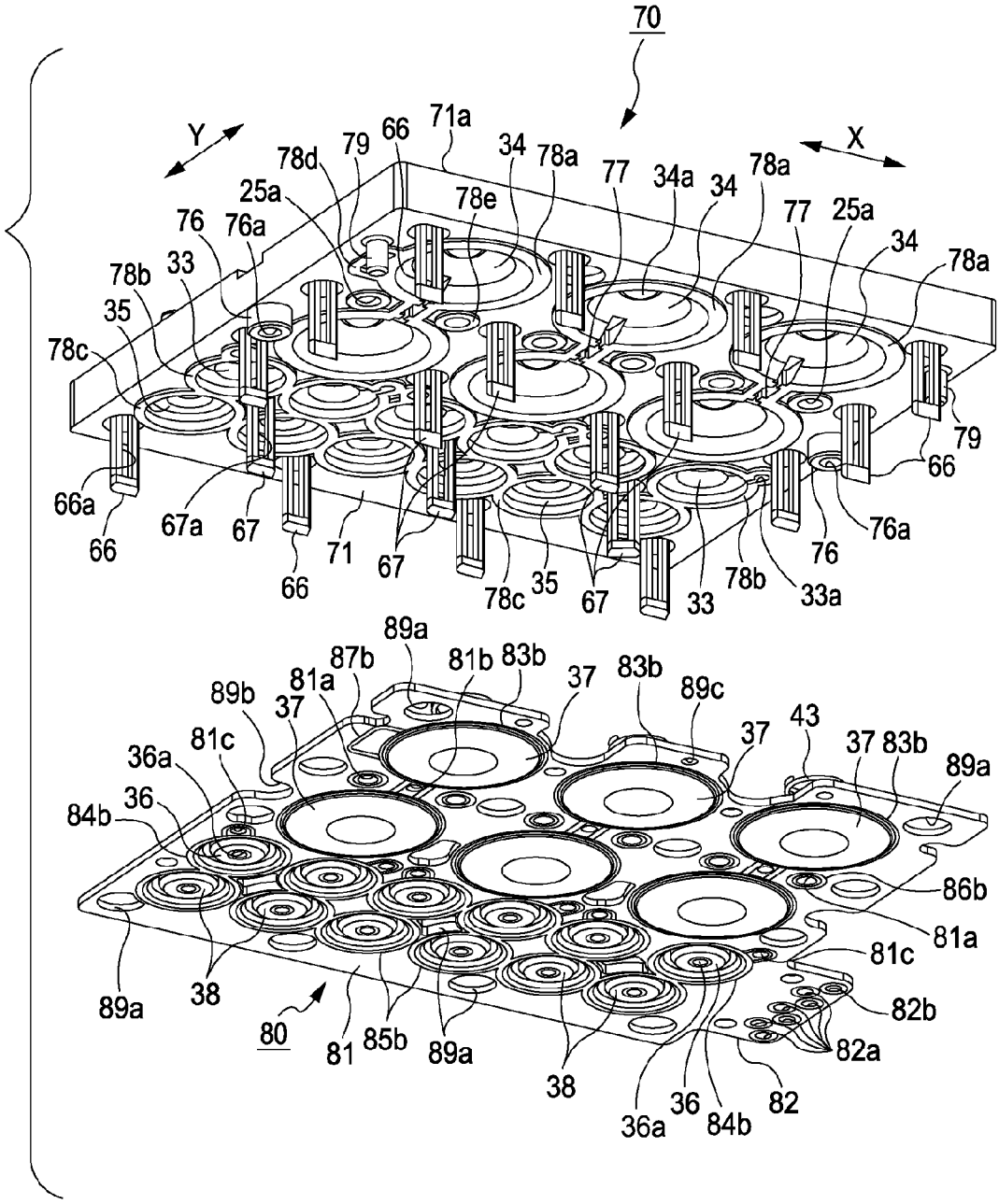
FIG. 8 is an exploded perspective view illustrating the bottom surfaces of the cover and the diaphragm forming member.
Figure 9:
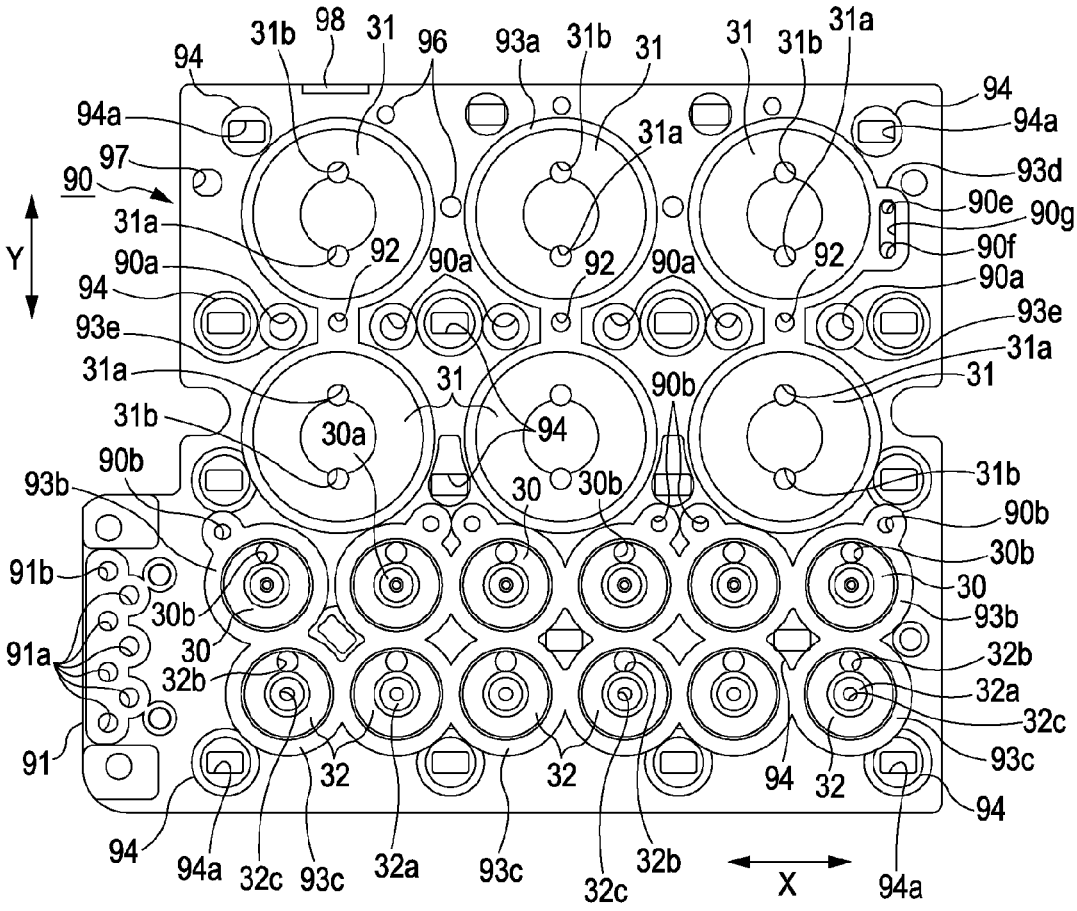
FIG. 9 is a plan view illustrating the passage forming plate.

FIG. 7 is an exploded perspective view illustrating the front surfaces (the upper surfaces) of the diaphragm forming member and the passage forming plate. FIG. 8 is an exploded perspective view illustrating the rear surfaces (the lower surfaces) of the cover and the diaphragm forming member. FIG. 9 is an exploded perspective view illustrating the passage forming plate and a film when viewed from the side of the rear surface.

As shown in FIG. 7, the cover 70 includes a board 71 which has a rectangular plate shape and in which the ink supply needles 25 of the plural rows protrude from the upper surface (the front surface). In a substantially ⅔ area of the upper surface of the board 71 in the vicinity of the location where the ink supply needles 25 are arranged in row, six pump housing sections 72 swelled in a substantially conic frustum shape toward the upper side (in the Z direction) are arranged in two rows at a uniform interval in the X direction so that three pump housing sections are arranged in one row.

The six ink supply needles 25 are arranged in gap areas, which correspond to row spaces between the pump housing pumps 72 arranged in two rows, at a uniform pitch (a pitch slightly broader than the width of the ink cartridge 13 in the X direction) in the X direction. At this time, the six ink supply needles 25 are located on both sides interposing the line segments connecting the central points of the three pairs of pump housing sections 72 each paired in the Y direction in a plan view of FIG. 6.

In the substantially remaining ⅓ area of the upper surface of the board 71, six sucking valve housing sections 73 swelled in the substantially conic frustum shape having a diameter smaller than that of the pump housing section 72 and six ejecting valve housing sections 74 swelled in a substantially conic frustum shape having almost the same diameter as that of the sucking valve housing section are respectively arranged in one row so as to be nearly adjacent in the X direction. The six sucking valve housing sections 73 are arranged in the vicinity of the pump housing sections 72 arranged in two rows and the six ejecting valve housing sections 74 are arranged in the vicinity of the row of the sucking valve housing sections 73. The six sucking valve housing sections 73 and the six ejecting valve housing sections 74 are located so as to be also nearly adjacent in the Y direction. On the front surface of the cover 70, an extension section 71*a* having a predetermined height is formed on nearly the whole circumference so as to surround the circumference. In addition, screw insertion holes 76*a* are formed at fastening positions of the screws 68 (see FIGS. 3 and 4) in the board 71.

As shown in FIG. 8, on the rear surface of the cover 70, the six concave sections 34 having a concave shape and forming the negative chamber 43*b* are formed at the positions corresponding to the pump housing sections 72. In addition, on the rear surface of the cover 70, six concave sections 33 having a concave shape are formed at the positions corresponding to the sucking valve housing sections 73 and six concave sections 35 having a concave shape are formed at the positions corresponding to the ejecting valve housing sections 74. The concave sections 33, 34, and 35 are formed in the substantially conic frustum shape on the inner circumferential surface having a concave shape. The concave sections 33 and 35 have a smaller diameter which is the substantial half of the diameter of that of the concave sections 34.

Columnar convex portions 34*a* inserted outwardly into the upper end of the coil spring 42 (see FIGS. 1, 5, and 7) protrude from the bottoms of the concave sections 34 having a cylindrical shape. The inner diameter of the bottom of the concave sections 33 and 35 having a substantially conic frustum shape is slightly larger than the outer diameter of the coil springs 40 and 44, and the upper end of the coil springs 40 and 44 are positioned at the substantial middle of the concave sections 33 and 35 by bringing the coil springs 40 and 44 into contact with the bottom of the concave sections 33 and 35.

On the rear surface of the cover 70, six through-holes 25*a* communicating with the ink supply needles 25 are formed at a uniform pitch in the X direction at the positions corresponding to the positions corresponding to the ink supply needles 25. Grooves 77 permitting the two adjacent concave sections 34 in the Y direction to communicate with each other are formed on the rear surface of the cover 70. The grooves 77 form a part of the air passage 46*b* for introducing the negative pressure into the two concave sections 34 (that is, the negative pressure chambers 43*b*) located at the both sides in the longitudinal direction. In addition, a groove 33*a* extending by a predetermined length from each of the concave sections 33 in the outward diameter direction is formed on the rear surface of the cover 70. The groove 33*a* forms a part of the second passage 15*b* for supplying the ink in the sucking valve 41 to the pump chamber 43*a*.

A sealing portion 78*a* which has a substantial 8-shape and extends in a strip shape having a nearly uniform width along the circumference of the two concave sections 34 adjacent to each other in the Y direction and the circumference of the groove 77 permitting both the concave sections 34 to communicate with each other is formed on the rear surface of the cover 70. A sealing portion 78*b* which has a substantially ring shape and extends in a strip shape with a nearly uniform width along the circumference of the concave section 33 and the groove 33*a* is formed. Moreover, a sealing portion 78*c* which has a substantially ring shape and extends in a strip shape with a nearly uniform width along the circumference of the concave section 35 is formed. A sealing portion 78*d* having a ring shape surrounding a long elliptical area is formed in the most left concave section 34 located in the first row in FIG. 8 so as to be conjunctive to the sealing portion 78*a*. A sealing portion 78*e* having a ring shape is also formed in the circumference of each through-hole 25*a*. The sealing portions 78*a* to 78*e* are formed in a convex shape with a height of the range from about several 10 μm to about several 100 μm from the bottom surface (the rear surface) of the cover 70.

A pair of positioning pins 79 protrude from the rear surface of the cover 70 at both the sides interposing the concave sections 34 located in the first row in the X direction. These pins 79 are used to position the cover 70 to the passage forming plate 90. A pair of boss sections 76 each having a screw insertion hole 76*a* for inserting the screw 68 protrude from the rear surface of the cover 70.

Next, the configuration of the diaphragm forming member 80 will be described.

The diaphragm forming member 80 shown in FIGS. 7 and 8 is made of rubber having rubber elasticity or elastomer. The diaphragm forming member 80 includes a sheet main body 81 which has a substantially rectangular shape having almost the same size as that of the cover 70 and an extension section 82 which extends from one end (the left lower end in FIG. 7) of the sheet main body 81 and forms a sealing portion of the pipe connection section 63. The sheet main body 81 is provided with the six diaphragms 37 which each have a circular disk shape and are disposed at the positions corresponding to the concave sections 34 of the cover 70, the six sucking valve bodies 36 which are disposed at the positions corresponding to the concave sections 33, and the six ejecting valve bodies 38 which are disposed at the positions corresponding to the concave sections 35. The diaphragm 37 has a large diameter to correspond to the concave section 34. The sucking valve body 36 and the ejecting valve body 38 have a small diameter which is the about half of that of the diaphragm 37 to correspond to the concave sections 33 and 35, respectively. As shown in FIG. 7, the diaphragm 37 has a flat columnar convex portion 37*a* on the upper middle surface thereof and the end (the lower end) of the coil spring 42 is inserted outwardly into the convex portion 37*a* to position the coil spring.

As shown in FIGS. 7 to 8, in the gap areas which are the row spaces between the diaphragms 37 arranged in two rows in the diaphragm forming member 80, six through-holes 81*a* are formed at the positions corresponding to the through-holes 25*a* of the ink supply needles 25 of the cover 70. Three through-holes 81*b* are formed at the positions between the through-holes 81*a* in the X direction, that is, the positions corresponding to the lines connecting the central points of the three pairs of diaphragms 37 arranged in the Y direction, respectively. The three through-holes 81*b* forms a part of the air passage 46*b* for introducing the negative pressure into the negative pressure chamber 43*b* together with the grooves 77 of the cover 70.

As shown in FIGS. 7 and 8, six through-holes 81*c* are formed in the vicinities of the sucking valve bodies 36 in the diaphragm forming member 80, respectively. The through-holes 81*c* form a part of the second passage 15*b* permitting the sucking valve 41 to communicate with the pump 43 and individually communicate with the front end of the grooves 33*a* (see FIG. 8) formed on the rear surface of the cover 70.

As shown in FIG. 7, the upper surface of the sucking valve body 36 protrudes in the cylindrical shape having a through-hole 36*a* (see FIG. 1), and the lower end of the coil spring 40 urging the sucking valve body 36 toward the lower side is inserted inwardly into the cylinder. In addition, the upper surface of the ejecting valve body 38 protrudes in a cylindrical shape with the bottom and the lower end of the coil spring 44 urging the ejecting valve body 38 toward the lower side is inserted inwardly into the cylinder.

As shown in FIG. 7, the front surface (the upper surface) of the diaphragm forming member 80 is provided with sealing portions 83*a* having a substantial 8-shape and sealing the circumferences of two diaphragms 37 and the through-hole 81*b* in the Y direction, sealing portions 84*a* having a substantial ring shape and sealing the circumferences of the sucking valve body 36 and the through-hole 81*c*, and sealing portions 85*a* having a ring shape and sealing the circumference of the ejecting valve body 38. As shown in FIG. 8, the rear surface (the lower surface) of the diaphragm forming member 80 is also provided with sealing portions 83*b* having a substantial 8-shape and sealing the circumferences of two diaphragms 37 and the through-hole 81*b* in the Y direction, sealing portions 84*b* having a substantial ring shape and sealing the circumferences of the sucking valve body 36 and the through-hole 81*c*, and sealing portions 85*b* having a ring shape and sealing the circumference of the ejecting valve body 38.

As shown in FIGS. 7 to 8, on the upper surface and the lower surface of the diaphragm forming member 80, sealing portions 86*a* and 86*b* having a ring shape are formed in the circumference of each through-hole 81*a*, respectively. On the upper surface and the lower surface of the diaphragm forming member 80, sealing portions 87*a* and 87*b* are formed at the positions corresponding to the sealing portion 78*d* of the cover 70. In addition, the sealing portions 83*a* to 87*a* and the sealing portions 83*b* to 87*b* are formed in a convex shape with the height of about several 10 μm to about several 100 μm, for example, from the bottom surface, and formed so as to be thinner than the corresponding sealing portions of the cover 70 and located in correspondence with the nearly middle in the width direction of the corresponding sealing portions of the cover 70. The sealing portions 83*a* to 87*a* on the front surface of the diaphragm forming member 80 and the sealing portions 83*b* to 87*b* on the rear surface thereof are formed so as to be plane-symmetry, respectively.

Six through-holes 82*a* serving as the ink discharging port 64 and one through-hole 82*b* serving as the negative pressure lead-out port 65 are formed in the extension section 82 of the diaphragm forming member 80. In addition, plural insertion holes 89*a* into which the locking hooks 66 and 67 are inserted and a pair of concave portions 89*b* into which the screws 68 are inserted are provided in the diaphragm forming member 80. Plural pin holes 89*c* are formed in the vicinity of the diaphragms 37 arranged in the first row.

Figure 10:
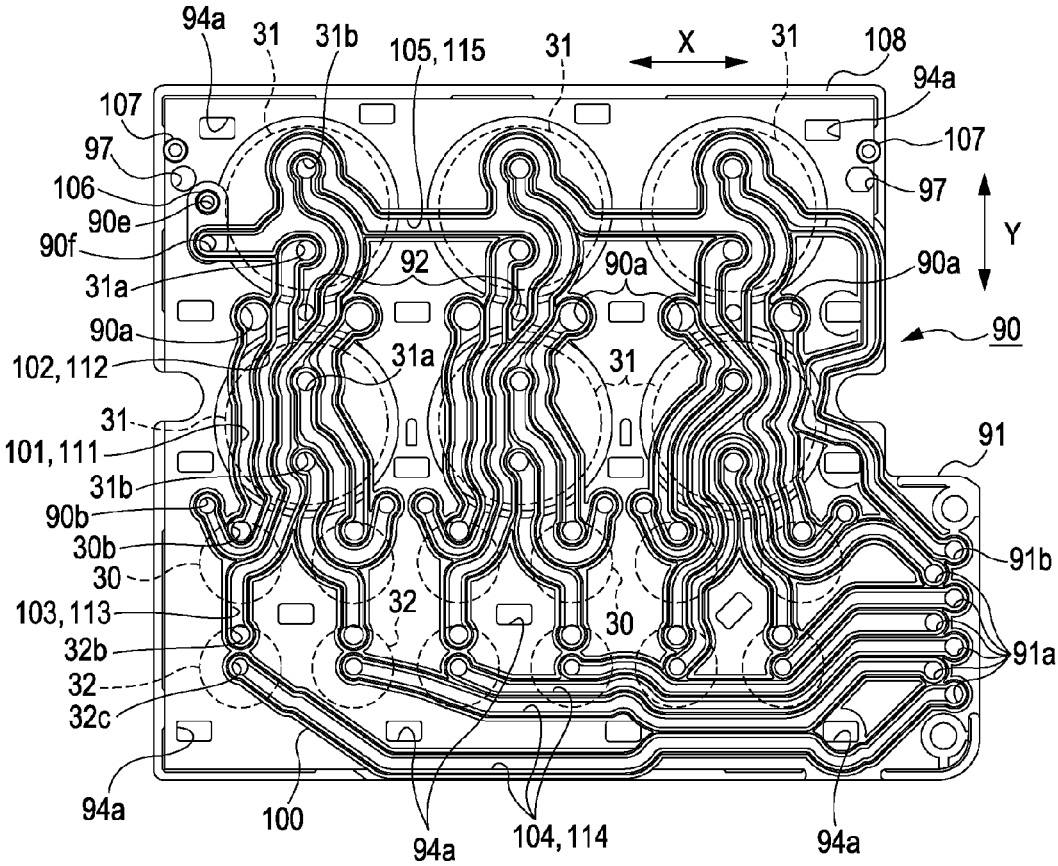
FIG. 10 is a bottom view illustrating the passage forming plate.
Figure 11:
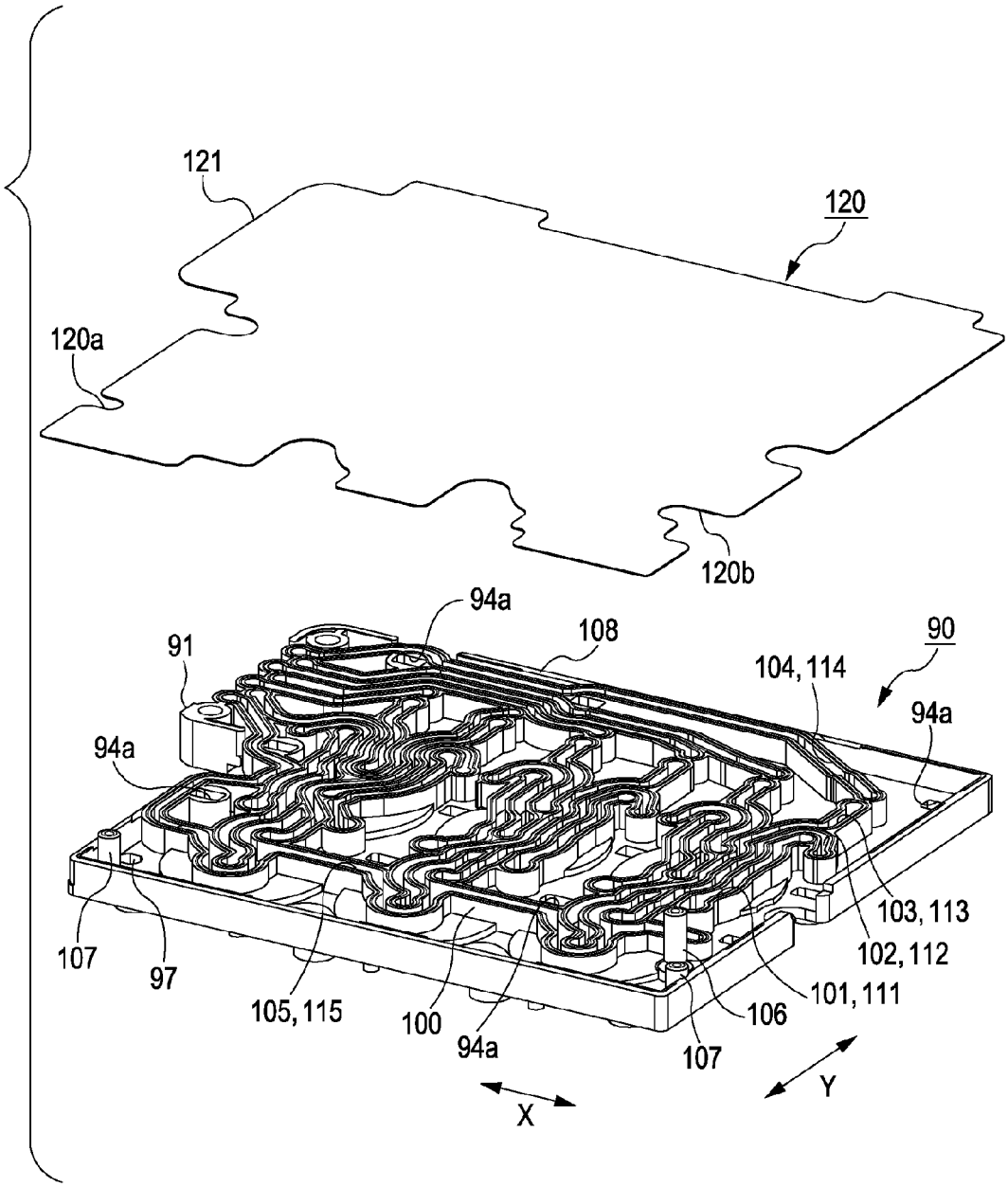
FIG. 11 is an exploded perspective view illustrating the passage forming plate and a film.

Next, the configuration of the passage forming plate 90 will be described with reference to FIG. 7 and FIGS. 9 to 11. FIG. 9 is a plan view illustrating the upper surface of the passage forming plate. FIG. 10 is a bottom view illustrating the rear surface (the bottom surface) of the passage forming plate. FIG. 11 is an exploded perspective view illustrating the passage forming plate and a film. In FIG. 10, reference numerals of the passage corresponding to the groove are given in a parenthesis.

The passage forming plate 90 shown in FIG. 7 and FIGS. 9 to 11 includes an extension section 91 at the position corresponding to the extension section 82 of the diaphragm forming member 80 and has the substantially same rectangular plate shape as that of the diaphragm forming member 80 in a plan view. The passage forming plate 90 according to this embodiment is made of a plastic material such as polypropylene (PP). The reason to use the polypropylene is because the polypropylene has a relatively high gas barrier performance (that is, a low gas permeable property) among plastic materials and is a material (a thermoplastic material) which easily welds the film 120.

As shown in FIGS. 7 and 9, on the upper surface of the passage forming plate 90, the six concave sections 31 are formed in the concave shape at the positions corresponding to the diaphragms 37, the six concave sections 30 are formed in the concave shape at the positions corresponding to the sucking valve bodies 36, and the six concave sections 32 are formed in the concave shape at the positions corresponding to the ejecting valve bodies 38. In the passage forming plate 90, the through-holes 90*a* are formed at the positions corresponding to the ink supply needles 25. The six through-holes 90*a* are arranged in one row at a uniform pitch in the X direction in the gap areas which are the row spaces between the concave sections 31 arranged in two rows. Through-holes 90*a* form a part of the first passage 15*a* and the ink supplied from the ink supply needles 25 are sent to the rear surface of the passage forming plate 90 via the through-holes 90*a*.

As shown in FIGS. 7 and 9, the through-hole 30*b* formed at the eccentric position located outside the valve seat 30*a* protruding at the middle of the concave section is formed in each of the concave sections 30. The through-hole 30*b* forms a part of the first passage 15*a* (see FIGS. 1 and 2) and serves as an inflow passage of the ink flowing from the rear surface of the passage forming plate 90 to the inside (the valve chamber 41*a*) of the sucking valve 41. The through-hole 90*b* is formed in the vicinity of each concave section 30. The through-hole 90*b* forms a part of the second passage 15*b* (see FIGS. 1 and 2) and serves as an outflow passage of the ink from the valve chamber 41*b* of the sucking valve 41 to the rear surface of the passage forming plate 90.

As shown in FIGS. 7 and 9, one pair of through-holes 31*a* and 31*b* are formed in the concave section 31 forming the pump chamber 43*a*. The through-hole 31*a* forms a part of the second passage 15*b* (see FIGS. 1 and 2) and serves as an outflow passage of the ink sucked into the pump chamber 43*a*.

On the other hand, the through-hole 31*b* forms a part of the third passage 15*c* (see FIGS. 1 and 2) and serves as an inflow passage of the ink ejected from the pump chamber 43*a*. In each concave section 32, the through-hole 32*b* is formed at the position located in the outer circumference of the valve seat 32*a* located at the middle of the bottom surface of the concave section 32 and having a circular plate shape and the through-hole 32*c* is formed at the middle of the valve seat 32*a*. The through-hole 32*b* forms a part of the third passage 15*c* (see FIGS. 1 and 2) and serves as an inflow passage through which the ink ejected from the pump 43 flows into the ejecting valve 45. On the other hand, the through-hole 32*c* forms a part of the fourth passage 15*d* (see FIGS. 1 and 2) and serves as an outflow passage of the ink flowing from the ejecting valve 45.

As shown in FIGS. 7 and 9, the six through-holes 91*a* (ink discharging holes) and one negative pressure lead-out hole 91*b* are formed in the extension section 91. The six through-holes 91*a* form a part of the fourth passage 15*d* (see FIGS. 1 and 2) and the one negative pressure lead-out hole 91*b* forms a part of the air passage 46*b* (see FIGS. 1 and 2).

Figure 14:
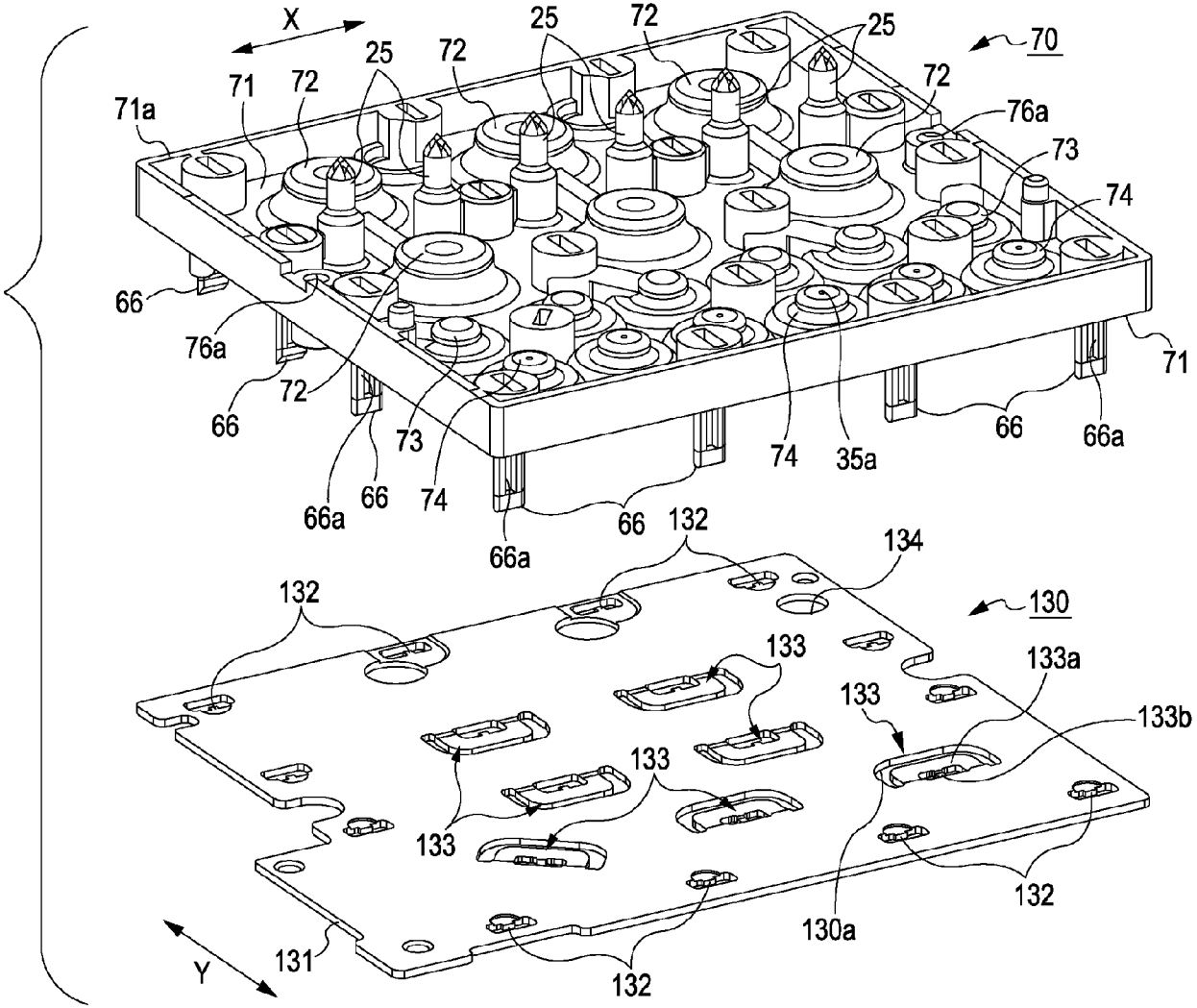
FIG. 14 is an exploded perspective view illustrating the cover and a protective plate.

In the right upper end of the passage forming plate 90 shown in FIG. 14, a pair of through-holes 90*e* and 90*f* and a groove 90*g* permitting both the through-holes 90*e* and 90*f* to communicate with each other are formed in the vicinity of the right concave section 31 located in the first row. The through-holes 90*e* and 90*f* and the groove 90*g* form a part of the air passage 46*b* (see FIG. 1) for introducing the negative pressure into the negative pressure chamber 43*b*.

In the gap areas which are the row spaces between the concave sections 31 arranged in the two rows, three through-holes 92 are individually formed at the positions corresponding to the nearly central points of the line segments connecting the central points of the three concave sections 31 each paired in the Y direction. The through-holes 92 form a part of the air passage 46*b* and serves as a passage for introducing the negative pressure. The introduced negative pressure reaches the grooves 77 on the rear surface of the cover 70 via the through-holes 81*b* of the diaphragm forming member 80 to be introduced to the two negative pressure chambers 43*b* located on both the side in Y direction via the grooves 77.

As shown in FIGS. 7 and 9, in the peripherals of the concave sections 30, 31, and 32, sealing portions 93*a*, 93*b*, 93*c*, 93*d*, and 93*e* extending in a strip shape so as to be nearly plane-symmetric with the sealing portions 78*a*, 78*b*, 78*c*, 78*d*, and 78*e* of the cover 70 protrude so as to have a width of about 0.5 mm to about 2 mm and a height of about several 10 μm to about several 100 μm, for example. The sealing portions 93*a*, 93*b*, 93*c*, 93*d*, and 93*e* are located to correspond to the sealing portions 83*b*, 84*b*, 85*b*, 86*b*, and 87*b* formed on the rear surface of the diaphragm forming member 80. Upon the assembly of the ink supply system 61, the sealing portions of the diaphragm forming member 80 having rubber elasticity are put and come in pressing contact between the sealing portions of the cover 70 and the sealing portions of the passage forming plate 90 to ensure the sealing property of the concave sections 30, 31, and 32.

As shown in FIGS. 7 and 9, boss sections 94 each having an insertion hole 94*a* protrude from the passage forming plate 90 at the positions corresponding to the locking hooks 66 and 67. Columnar pins 96 having an outer diameter slightly smaller than the inner diameter of the pin hole 89*c* protrude from the passage forming plate 90 at the positions corresponding to the pin holes 89*c* of the diaphragm forming member 80. Positioning holes 97 having the inner diameter slightly larger than the outer diameter of the pin 79 are provided in the passage forming plate 90 at the positions corresponding to the pins 79 of the cover 70.

The plural (in this embodiment, nineteen) boss sections 94 are inserted into the screw insertion holes 89*a* of the diaphragm forming member 80 and the pins 96 are inserted into the pin holes 89*c*, so that the diaphragm forming member 80 is positioned to the passage forming plate 90 in a state where the sucking valve bodies 36, the diaphragms 37, and the ejecting valve bodies 38 face the concave sections 30, 31, and 32, respectively. In addition, the pins 79 of the cover 70 are inserted into the positioning holes 97, so that the cover 70 is positioned to the passage forming plate 90 and the diaphragm forming member 80 is positioned to the passage forming plate 90.

Here, the protrusion height of the boss sections 94 of the passage forming plate 90 and the boss sections 76 (see FIG. 8) of the cover 70 is configured such that a gap between the passage forming plate 90 and the cover 70 is determined as a predetermined value by bringing the upper end surface of the boss sections 94 into contact with the rear surface of the cover 70 and by bringing the upper end surface of the boss sections 76 into contact with the upper surface of the passage forming plate 90. That is, the gap between the cover 70 and the passage forming plate 90 becomes narrower than a valve for engaging the locking hooks 66 and 67 with the lockable members 132 and 133 (see FIG. 6), the boss sections 76 and 94 come in contact with the surfaces of the members on the opposite side, and the sealing portions of the diaphragm forming member 80 are compressed at the contact positions. The sealing portions 83*a*, 83*b*, 84*a*, 84*b*, 85*a*, 85*b*, 86*a*, 86*b*, 87*a*, and 87*b* of the diaphragm forming member 80 are inserted between the sealing portions of the cover 70 and the passage forming plate 90 by an appropriate pressurizing force suitable for the sealing to come in pressing contact with each other in the state where the locking hooks 66 and 67 are engaged with the lockable members 132 and 133 (see FIG. 6).

Next, the configuration of the rear surface (the bottom surface) of the passage forming plate 90 will be described. As shown in FIG. 10, on the rear surface of the passage forming plate 90, a partition wall 100 forming side walls of the passages 15*a* to 15*d* and 46*b* (see FIGS. 1 and 2) extends along a predetermined passage path. The partition wall 100 is closed in the shape of a blind passage in all passages 15*a* to 15*d* and 46*b*. Plural grooves (hereinafter, referred to as "a first groove 101 to a fifth groove 105) formed such that a gap (which is a gap of adjacent portions extending substantially parallel) is a groove width are formed in the partition wall 100. In this embodiment, as shown in FIG. 11, by welding the film 120 onto the passage forming surface (the bottom surface) of the passage forming plate 90, the spatial areas surrounded by the first groove 101 to the fifth groove 105 and the film 120 serve as passages 111 to 115 passing through the rear surface of the passage forming plate 90. At this time, the four kinds of first groove 101 to fourth groove 104 serve as the first ink passage 111 to the fourth ink passage 114, respectively, and are provided in each of the six ink supply devices 14. The other one kind of fifth groove 105 serves as the air passage 115 and one groove is provided in a passage passing through the vicinity of the negative pressure chamber 43*b* of each of the six ink supply devices 14.

As shown in FIGS. 10 and 11, in one corner (the left upper corner in FIG. 10) of the rear surface of the passage forming plate 90, one negative pressure introducing tube 106 protrudes vertically from the rear surface. One end of the air passage pipe 46*a* (see FIG. 1) connected to the negative pressure generating device 47 is connected to the negative pressure introducing tube 106. The negative pressure introducing tube 106 serves as a port for introducing negative pressure to the ink supply system 61. The air passage groove 105 communicating with the tube 106 extends in a passage formed up to the negative pressure lead-out hole 91*b* via three through-holes 92.

A pair of pins 107 positioning the protective plate 130 to the passage forming plate 90 protrude at the upper right and left positions of the rear surface of the passage forming plate 90 in FIG. 10. An extension section 108 having the substantially same height of that of the partition wall 100 is formed in nearly the whole circumference of the rear surface of the passage forming plate 90.

As shown in FIG. 11, the film 120 is formed in a substantially rectangular shape having almost the same circumference as that of the passage forming plate 90, and welded to the end surfaces (the upper end surface in FIG. 16) of the partition wall 100 and the extension section 108. The film 120 is formed of a lamination film formed by interposing a metal plate between resin layers. A gas barrier property is improved due to the metal plate (for example, an aluminum plate) and the welding to the passage forming plate 90 is ensured due to the resin layer (for example, thermoplastic resin such as polypropylene) of the surface. Moreover, the film 120 includes an extension section 121 corresponding to the extension section 91 of the passage forming plate 90 and concave portions 120*a* and 120*b* for avoiding the tube 106 and the pins 107 of the passage forming plate 90, respectively.

Figure 12:
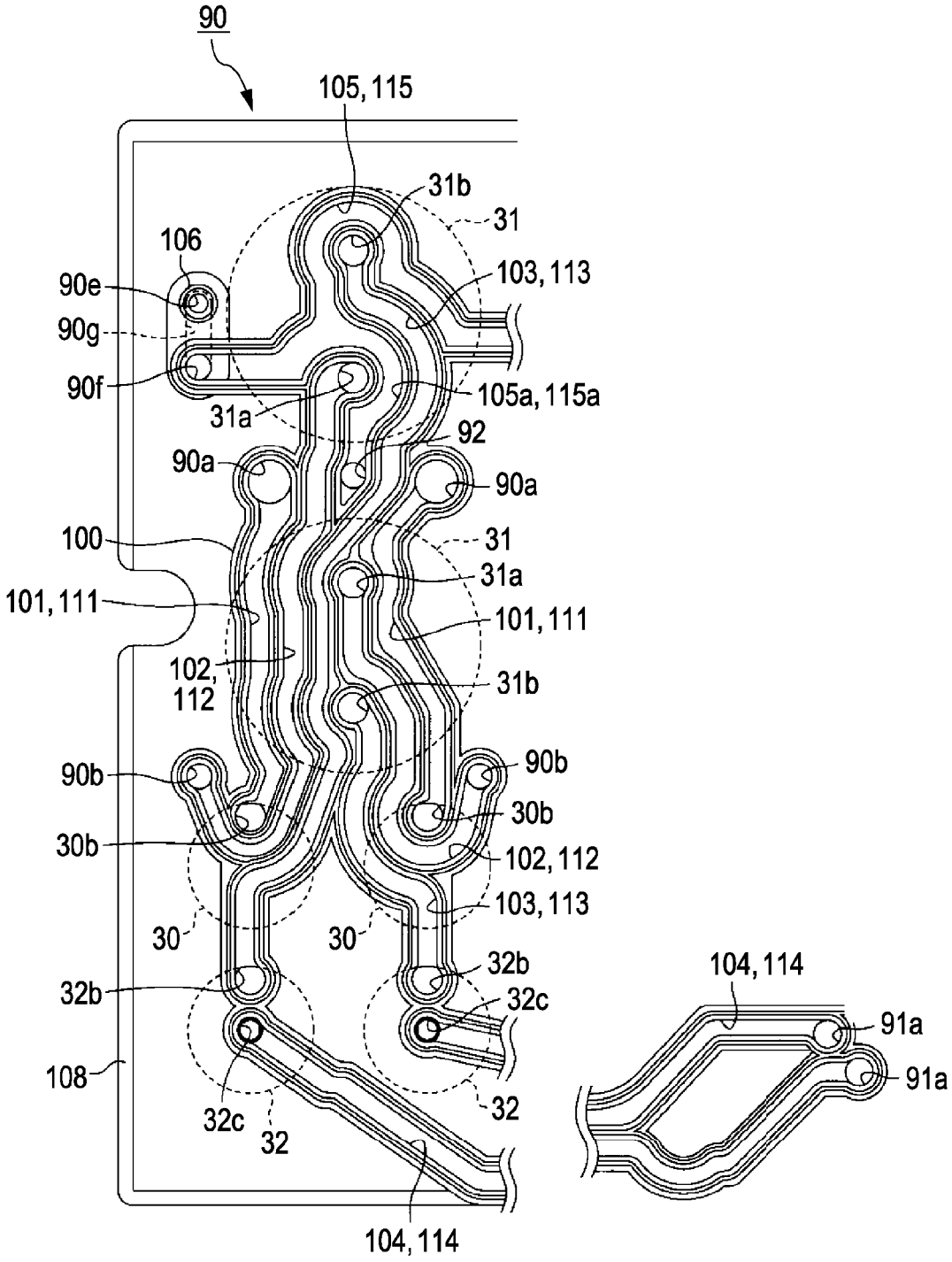
FIG. 12 is a partial bottom view for explaining an ink passage of the passage forming plate.
Figure 13:
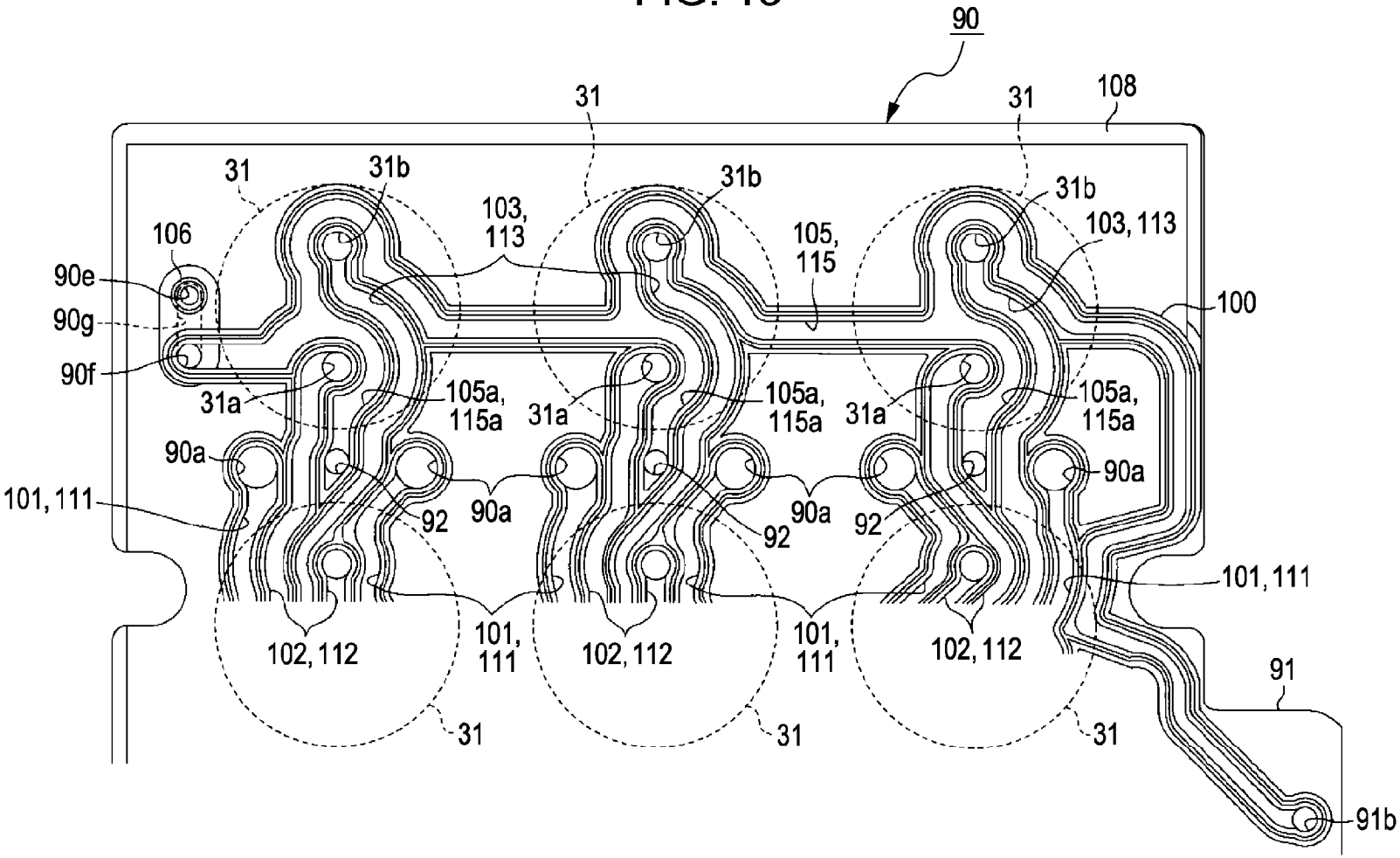
FIG. 13 is a partial bottom view for explaining an air passage of the passage forming plate.

FIG. 12 is a partial bottom view illustrating a portion associated with an ink passage on the rear surface of the passage forming plate. FIG. 13 is a partial bottom view mainly illustrating the air passage on the rear surface of the passage forming plate. In FIGS. 12 and 13, the portions (the boss sections, etc.) other than the passages (the grooves) are not illustrated. In FIG. 12, the portions corresponding to the two ink supply devices 14 are illustrated. Here, similarly to FIG. 10, in FIGS. 12 and 13, reference numerals are given to the passages corresponding to the grooves. In the following description, the groove 101 is considered to be the passage formed after the film welding for explanation.

As shown in FIGS. 10 and 12, the first ink passage groove 101 to the fourth ink passage groove 104 are surrounded by spaces with the film 120 welded onto the rear surface of the passage forming plate 90 to serve as the first ink passage 111, the second ink passage 112, the third ink passage 113, and the fourth ink passage 114, respectively.

As for six groups of the ink passages 111 to 114 forming each of the six ink supply devices 14, since the location relation of the ink supply needles 25, the pump 43, the sucking valves 41, and the ejecting valves 45 is slightly different from each other in the ink supply device 14 in which the pumps 43 are located in the first row (the lower row in FIG. 10) and the ink supply device 14 in which the pumps 43 are located in the second row (the lower row in FIG. 10), the passage path and the like are slightly different in each of the ink supply devices 14. However, the groups of the ink passages 111 to 114 basically have the same configuration, except for the slightly different paths. Accordingly, in FIG. 12, the ink passages will be described focusing the two ink supply devices 14 located opposite the pipe connection section 63 (see FIGS. 3 and 4).

In FIG. 12, the upper-side concave section 31 of the two concave sections 31 arranged in the upper and lower sides and the left concave sections 30 and 32 among the concave sections 30 and 32 arranged right and left correspond to one ink supply device 14. The lower-side concave section 31 and the right concave sections 30 and 32 correspond to the other ink supply device 14.

As shown in FIG. 12, the first ink passage 111 (the first groove 101) is a passage permitting the through-hole 90*a* corresponding to the ink supply needle 25 to communicate with the through-hole 30*b* of the sucking valve 41 (the concave section 30). Accordingly, upon the sucking drive of the pump 43, the ink flowing from the ink supply needle 25 to the rear surface of the passage forming plate 90 via the through-hole 90*a* flows to the through-hole 30*b* via the first ink passage 111 and then flows from the through-hole 30*b* to the sucking valve 41.

The second ink passage 112 is a passage permitting the through hole 90*b* in the vicinity of the sucking valve 41 (the concave section 30) to communicate with the through-hole 31*a* of the pump 43 (the concave section 31). Accordingly, upon the sucking drive of the pump 43, the ink flowing from the through-hole 90*b* to the rear surface of the passage forming plate 90 via the sucking valve 41 which has been opened by the ink pressure (the negative pressure) caused by the sucking drive flows to the through-hole 31*a* via the second ink passage 112 and then flows from the through-hole 31*a* to the pump chamber 43*a*.

The third ink passage 113 is a passage which permits the through-hole 31*b* of the pump 43 (the concave section 31) to communicate with the through-hole 32*b* of the ejecting valve 45 (the concave section 32). Accordingly, upon the ejecting drive of the pump 43, the ink ejected from the pump chamber 43*a* and flowing from the through-hole 31*b* to the rear surface of the passage forming plate 90 flows to the through-hole 32*b* via the third ink passage 113 and then flows from the through-hole 32*b* to the ejecting valve 45.

The fourth ink passage 114 serves as a passage which permits the through-hole 32*c* of the ejecting valve 45 (the concave section 32) to communicate with the through-hole 91*a* of the extension section 91. Accordingly, upon the ejecting drive of the pump 43, the ink flowing from the through-hole 32*c* to the rear surface of the passage forming plate 90 via the ejecting valve 45 which has been opened by the ink pressure pressurized by the ejecting drive flows to the through-hole 91*a* via the fourth ink passage 114 and then flows from the ink discharging port 64 of the pipe connection section 63 via the through-hole 91*a*.

Next, the air passage to which the negative pressure is introduced will be described. As shown in FIG. 13, the negative pressure from the negative pressure introducing tube 106 is introduced to the air passage 115 on the rear surface via the groove 90*g* and the through-hole 90*f* of the passage forming plate 90. The air passage 115 extends from the through-hole 90*f* to the negative pressure lead-out hole 91*b* sequentially through the positions corresponding to the rear surface of the pump chambers 43*a* (the concave sections 31) of the pumps 43 arranged in the first row. Moreover, the air passage 115 includes three air passages 115*a* diverged from the positions individually corresponding to the rear surface of the pump chambers 43*a* (the concave sections 31) to extend toward the lower side of FIG. 18. The air passage 115 communicates with the three through-holes 92 individually corresponding to the diverged three air passages 115*a*. Accordingly, the negative pressure introduced into the air passage 115 via the tube 106 of the ink supply system 61 upon the sucking drive of the pumps 43 is led out from the through-holes 92 to the front surface of the passage forming plate 90 via the diverged air passages 115*a*. In addition, the negative pressure led out from the through-holes 92 reaches the middle portion in the length direction of the grooves 77 of the rear surface of the cover 70 via the through-holes 81*b* of the diaphragm forming member 80 and then is introduced along the grooves 77 to the two negative pressure chambers 43*b* located on both the sides in the length direction.

FIG. 14 is an exploded perspective view illustrating the cover and the protective plate. The protective plate 130 shown in FIGS. 5, 6, 14 is formed of a metal plate, for example, having almost the same outer circumferential shape as that of the film 120. The protective plate 130 includes an extension section 131 corresponding to the pipe connection section 63 and the plural lockable members 132 and 133 at the positions corresponding to the locking hooks 66 and 67. A hole 134 into which the tube 106 is inserted is formed at the position corresponding to the tube 106 of the protective plate 130 on the side of the passage forming plate 90.

As shown in FIGS. 8 and 14, the cover 70 is a part of the main body 62 in the cover 70 assembled as the ink supply system 61. The total nineteen locking hooks 66 and 67 as a locking member vertically extend on the bottom surface (the rear surface) of the cover 70. The total twelve locking hooks 66 extend along the circumference of the rear surface of the cover 70 at a predetermined interval. That is, four locking hooks 66 are formed at the four corners of the rear surface of the cover 70 and each two locking hooks 66 are formed between the four locking hooks 66.

As shown in FIG. 8, the total seven locking hooks 67 are disposed in more inside than the disposed positions of the twelve locking hooks 66 on the rear surface of the cover 70 and extend at the positions of the gap areas of the concave sections 34, 33, and 35 forming pumps 43 and the valves 41 and 45. Specifically, among the seven locking hooks 67, two locking hooks are formed in two gap areas surrounded by the four pumps 43 (the concave sections 34 in the cover 70), two locking hooks are formed in two gap areas surrounded by the two pumps 43 and the two sucking valves 41 (the concave sections 33 in the cover 70), and three locking hooks are formed in three gap areas which are the other gap areas among the five gap areas surrounded by the two sucking valves 41 and the two ejecting valves 45 (the concave sections 35 in the cover 70). The two kinds of locking hooks 66 and 67 have the same shape except the locking hooks 66 lock at the positions of the circumference of the main body 62 and the locking hooks 67 lock at the positions located inside the main body 62 and corresponding to the gap areas of the pumps 43 and the valves 41 and 45. The locking hooks 66 and 67 extend in a rectangular plate shape having a predetermined thin long size and locking holes 66*a* and 67*a* having a thin long rectangular shape are formed in the locking hooks 66 and 67, respectively. Instead of the locking holes 66*a* and 67*a*, locking concave portions may be formed.

As shown in FIG. 14, twelve lockable members 132 are formed in the circumference of the protective plate 130 at the positions corresponding to the twelve locking hooks 66. The lockable member 132 is a locking claw formed in a predetermined shape of a remaining portion after a metal plate as a material in a manufacturing process of the protective plate 130 is punched. Seven lockable members 133 are formed inside the protective plate 130 at the positions corresponding to the seven locking hooks 67. In this embodiment, the locking hook 66 and the lockable member 132 constitute a first locking member and the locking hook 67 and the lockable member 133 constitute a second locking member. The first and second locking members constitute a locking unit.

Figure 15:
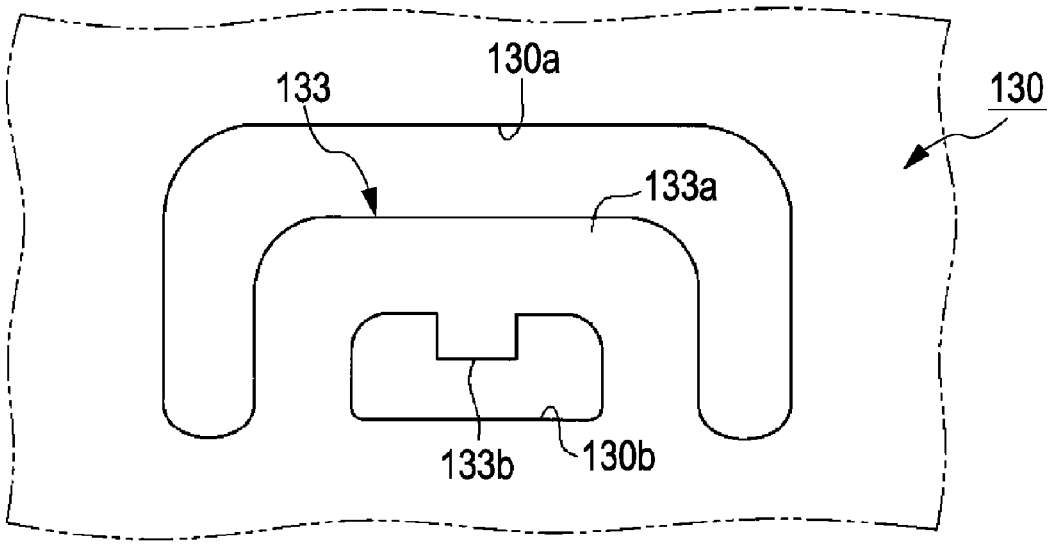
FIG. 15 is a schematic plan view illustrating a lockable member.

FIG. 15 is a schematic plan view illustrating the lockable member 133. As shown in FIGS. 14 and 15, the lockable member 133 includes a plate spring 133*a*, which is formed in the shape of a remaining portion after a material plate as a material in the manufacturing process of the protective plate 130 is punched to form a hole 130*a*, and a locking nail 133*b* which protrudes from the plate spring 133*a*. The plate spring 133*a* has a substantially U-shape and two ends thereof extend from a metal board in a state where a metal board portion does not form the lockable member is connected to the metal board. The locking nail 133*b* protrudes to the inner circumference of the plate spring 133*a*. The locking nail 133*b* is formed to have a width slightly narrower than the hole width of the locking hole 67*a* of the locking hook 67. In addition, the locking nail 133*b* can be inserted into the locking hole 67*a*.

Figure 16:
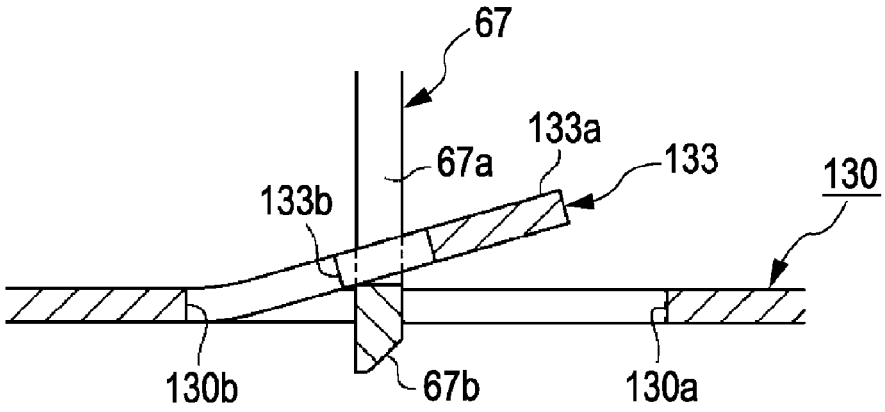
FIG. 16 is a schematic sectional view illustrating an engagement state of a locking hook and a lockable member.

FIG. 16 is a schematic sectional view illustrating an engagement state of the locking hook and the lockable member. As shown in FIG. 16, the front end (the lower end) of the locking hook 67 is provided with a guiding surface 67*b* formed as an inclined surface having a thickness which is as thin as the front end. When the guiding surface 67*b* of the front end of the locking hook 67 first comes in contact with the locking nail 133*b* of the lockable member 133 and then the locking hook 67 is relatively moved toward the lower side of FIG. 16 with respect to the lockable member 133, the locking nail 133*b* slides along the guide surface 67*b* and thus the locking hook 67 is pushed in a direction (a left direction in FIG. 16) moving away from the locking nail 133*b*. When the locking hole 67*a* of the locking hook 67 reaches the position corresponding to the locking nail 133*b*, the locking nail 133*b* is inserted into the locking hole 67*a* and thus the locking hook 67 and the lockable member 133 engages with each other in the locked state. In addition, a guiding surface formed as an inclined surface is formed in the front end of the locking hook 66.

The ink supply system 61 is assembled in the following manner. The members 80, 90, 120, and 130 are laminated after the film 120 is welded in advance on the rear surface of the passage forming plate 90. Then, the cover 70 is pushed until the locking hooks 66 and 67 engage with the lockable members 132 and 133 of the protective plate 130, while the locking hooks 66 and 67 of the cover 70 are inserted into the insertion holes 89*a* and 94*a* of the members 80 and 90 from the upper side. As a consequence, the locking hooks 66 and 67 engage with the lockable members 132 and 133 and the diaphragm forming member 80 is inserted between the cover 70 and the passage forming plate 90 in the pressurized state, so that the cover 70 and the protective plate 130 are fixed by the locking. In this way, the lamination structure of the members 70, 80, 90, 120, and 130 can be assembled in the state where the sealing property is ensured between the members 70, 80, and 90. In addition, the ink supply system 61 can be assembled by laminating the receiving plate 140 on the bottom surface of the lamination structure in the state and inserting the two screws 68 into the screw insertion holes 76*a* to fasten the receiving plate from the lower side.

At this time, by inserting the boss sections 94 and the pins 96 of the passage forming plate 90 into the insertion holes 89*a* and the pin holes 89*c* of the diaphragm forming member 80, respectively, in the laminated state of the members 70, 80, 90, 120, and 130 before the screw fastening, the diaphragm forming member 80 is positioned to the passage forming plate 90 in the state where the sucking valve bodies 36, the diaphragms 37, and the ejecting valve bodies 38 face the concave sections 30, 31, and 32, respectively. In addition, by inserting the pins 79 into the positioning holes 97, the cover 70 is positioned to the passage forming plate 90 in the state where the sucking valve bodies 36, the diaphragms 37, and the ejecting valve bodies 38 face the concave sections 33, 34, and 35, respectively.

In the state where the members 70, 80, 90, 120, and 130 are locked and fixed, the gap between the cover 70 and the passage forming plate 90 is determined by a length from the bottom surface of the cover 70 to the locking position (that is, the front end engaging with the lockable members 132 and 133 in the openings of the locking holes 66*a* and 67*a*) of the locking hooks 66 and 67. Since this gap is determined by the length from the base end of the locking hooks 66 and 67 to the front end of the locking holes 66*a* and 67*a*, the non-uniformity in the gap rarely occurs in the ink supply system 61. Accordingly, in the state where the locking hooks 66 and 67 engage with the lockable members 132 and 133, the sealing portions of the diaphragm forming member 80 is inserted between the sealing portions of the passage forming plate 90 and the cover 70 in the pressurized state and compressed by a pressurizing force suitable for the sealing. As a consequence, the sealing property of the pumps 43 and the valves 41 and 45 are ensured.

For example, when the fastening is carried out excessively strong due to the non-uniformity in the fastening force in the case of using the fastening member such as screws or bolts, the sealing portions of the diaphragm forming member (the flexible member) is excessively pressed and deformed, the rubber of the portion excessively pressed and deformed is pushed toward the inside of the valve chamber, and some sucking valve bodies or some ejecting valve bodies become loose. For this reason, the opening or closing time of the valve for the ink pressure may become different in the valves (the unidirectional valves) of which the valve bodies become loose and the valves of which the valve bodies do not become loose. For example, the opening or closing time of the sucking valve body may become different and thus the sucking valve which has to be closed when the negative pressure chamber of the pump is opened to the air may not be completely closed. In this case, when the ink cartridge is detached, the pressurized ink may flow backward and thus the ink may leak from the ink supply needle.

In the configuration according to this embodiment, however, since the sealing portions 84*a* and 84*b* of the diaphragm forming member 80 is not excessively pressed and deformed, the non-uniformity in the opening or closing time of the sucking valve 41 for the ink pressure rarely occurs in the ink supply system 61. In addition, when the negative pressure chamber 43*b* is opened to the air, the sucking valve 41 is completely closed. As a consequence, when a user detaches the ink cartridge 13, the ink pressurized in the ink supply system 61 can be prevented from flowing backward and leaking from the ink supply needle 25.

When the ejecting valve does not completely close in spite of the ink pressure for closing the valve due to the non-uniformity in the opening or closing time of the ejecting valve for the ink pressure, the non-uniformity in the amount of ink flowing between the ink passages of the ink colors may occur. In the configuration according to this embodiment, however, since the sealing portions 85*a* and 85*b* of the diaphragm forming member 80 are not excessively pressed and deformed and the ejecting valve bodies 38 do not become loose, the ejecting valves 45 are surely closed upon the sucking drive of the pumps 43. As a consequence, the non-uniformity in the amount of ink flowing between the ink passages of the ink colors rarely occurs.

The excessive pressing and deformation of the sealing portions can be prevented. However, when an urging force in the valve closing direction of the sucking valve body 36 and the ejecting valve body 38 is weak, the ink leakage in the sucking valve 41 and the ejecting valve 45 may occur. In order to solve this problem, a check valve configuration having the coil springs 40 and 44 (the urging members) urging the sucking valve body 36 and the ejecting valve body 38 in the valve closing direction is intentionally used to ensure that the valve closes, even though the size of the sucking valve 41 and the ejecting valve 45 is increased.

Even though the size of the sucking valve 41 and the ejecting valve 45 is increased, the compact ink supply system 61 is configured by disposing the six pumps 43, the six sucking valves 41, and the six ejecting valves 45 on the same plane in the main body 62 of the ink supply system 61 in a relatively precise manner. In this case, the pumps 43 having the relatively large diameter are arranged in two rows, the six ink supply needles 25 are arranged in one row at the same interval in the spatial areas between the rows of the pumps, and the six sucking valves 41 and the six ejecting valves 45 are arranged in one row in the direction parallel to the rows of the pumps in the areas adjacent to the rows of the pumps.

In this layout, the pumps 43 and the valves 41 and 45 are precisely arranged, but the positions of the ink supply needles 25, the pumps 43, and the valves 41 and 45 may be relatively distant from each other. Therefore, the passages 15*a*, 15*b*, 15*c*, and 15*d* may be relatively lengthened. In this embodiment, however, the passages 15*a*, 15*b*, 15*c*, and 15*d* surrounded by the grooves 101 to 104 and the film 120 are disposed on the rear surface opposite to the surface (the front surface) of the passage forming plate 90 provided with the pumps 43 and the valves 41 and 45, by providing the plural grooves 101 to 104 on the rear surface of the passage forming plate 90 and welding the film 120 on the rear surface thereof. With such a configuration, the passages 15*a*, 15*b*, 15*c*, and 15*d* can be assembled in one same component without sacrificing the relatively precise layout of the pumps 43 and the valves 41 and 45.

In a state where the six ink cartridges 13 are mounted on the ink supply needles 25 of the ink supply system 61, respectively, in FIG. 3, assuming that a projection range obtained by projecting an area (a minimum rectangular area containing the six ink cartridges 13 in a plan view) for disposing the six ink cartridges 13 on the upper surface of the ink supply system 61 in the lamination direction is "a cartridge projection range", the six pumps 43 are laid out relative to the positions of the six ink supply needles 25 such that all the central points of the six pumps fall within the cartridge projection range. The six sucking valves 41 arranged in one row are laid out relative to the positions of the six ink supply needles 25 such that all the central points of the sucking valves fall within the cartridge projection range. The six ejecting valves 45 arranged in one row are also laid out relative to the positions of the six ink supply needles 25 such that all the central points of the ejecting valves fall within the cartridge projection range. That is, in this embodiment, the six pumps 43, the six sucking valves 41, and the six ejecting valves 45 are laid out such that all the central points thereof fall within the cartridge projection range determined by the positions of the six ink supply needles 25.

The cartridge projection range is within the upper surface of the compact main body 62 formed so as to have a relatively compact size by laying out the six ink supply needles 25, the six pumps 43, the six valves 41, and the six valves 45 in a relatively precise manner. With such a configuration, a space required to dispose the ink supply system 61 (the cartridge holder) and the six ink cartridges 13 in the printer 11 can be restrained so as to be relatively small. As a consequence, it is possible to make the printer 11 compact.

The first ink passage 111 to the fourth ink passage 114 formed on the rear surface of the passage forming plate 90 extend so as to be spaced from and adjacent to the partition wall 100 at the portions (the areas between the through-holes 90*a* in the vertical direction of FIG. 12 and the vicinities of the middles of the concave sections 30) corresponding to the path of the first to fourth ink passages. For example, when the outside of the partition wall is in contact with the air (the atmosphere), the air gas-permeates the partition wall to be dissolved in the ink flowing inside the partition wall and the dissolved air may become bubbles in the ink. Alternatively, the moisture of the ink may permeate the partition wall and evaporate. In this embodiment, however, since the ink of the other ink passages flows outside the partition wall 100, it is possible to prevent the cause that the air permeates the partition wall and is dissolved in the ink to make the bubbles or the cause that the moisture of the ink permeates the partition wall and the ink is evaporated, compared to a configuration in which the partition wall faces the air. As a consequence, the bubbles rarely occur in the ink and it is easy to prevent a failure in the ejection of ink droplets caused due to the bubbles. Moreover, it is easy to prevent a failure in the ejection of the ink droplets caused by clogging of the nozzles occurring because the ink is easily thickened due to the moisture evaporation.

Since the protective plate 130 formed of a metal plate is disposed on the lower side of the film 120, the passage forming plate 90 made of a plastic material (PP) can be prevented from being deformed in a rippling shape due to the distribution of a force relatively strongly pushed in the locking positions in the state where the locking hooks 66 and 67 engage with the lockable members 132 and 133. Accordingly, since the flatness of the passage forming plate 90 is guaranteed even in the locking state, it is possible to prevent the sealing performance from deteriorating due to the deformation of the rippling shape in the passage forming plate and ensure the sealing property, for example.

The ink leaking to the upper surface of the cover 70 upon mounting or detaching the ink cartridge 13 or the ink leaking from the gap between the sealing portions of the diaphragm forming member 80 is accumulated in the receiving plate 140 disposed in the lowermost layer through a hole (not shown). In addition, the receiving plate 140 is provided with a drain passage at one position of the circumference and the ink is discharged to the outside along the drain passage to be collected in the waste liquid tank 21. Accordingly, it is possible to prevent the inside of the printer 11 from being smeared due to the waste ink leaking from the ink supply system 61.

As described in detail above, the following advantages can be obtained according to this embodiment.

(1) The cover 70 and the protective plate 130 engage with each other and are fixed by the engagement of the locking hooks 66 and 67 with the lockable members 132 and 133 with the diaphragm forming member 80 interposed between the passage forming plate 90 and the cover 70 in the pressurized state. Accordingly, when the cover 70 is pressed down until the engagement of the locking hooks 66 and 67 of the cover 70 with the lockable members 132 and 133 of the protective plate 130 through the insertion holes 89*a* of the diaphragm forming member 80 and the holes 94*a* of the passage forming plate 90, the members 70, 80, 90, 120, and 130 can be assembled in the laminated state. As a consequence, it is possible to assemble the ink supply system 61 in a relatively simple manner, compared to a configuration of assembling the members in the laminated state by fastening the fastening members such as screws or bolts.

(2) Since the gap between the passage forming plate 90 and the cover 70 is nearly uniformly determined uniquely by the length to the locking position of the locking hooks 66 and 67, the non-uniformity in this gap rarely occurs in the ink supply system 61. Accordingly, the diaphragm forming member can be prevented from being excessively pressed and deformed due to the fastening of an excessively strong force due to the non-uniformity of the fastening force, which is a problem when the configuration fastened by the fastening member is used. Therefore, the non-uniformity in the opening or closing time of the valves 41 and 45 caused because the diaphragm forming member 80 is excessively pressed and deformed rarely occurs. Moreover, the valves 41 and 45 are surely closed when the valve closeness is required. As a consequence, it is possible to prevent the ink from leaking from the ink supply needle 25 when the ink cartridge 13 is detached. Moreover, it is possible to prevent the amount of ink flowing from the ink supply system 61 from being not uniform between the ink colors. In a known configuration assembled by use of the fastening member, the ink on the downstream area is depressurized and thus a necessary ink pressurizing value may not be guaranteed when the delay of the valve closing time of the sucking valve occurs upon starting the ejecting drive or the valve closeness is incomplete. Alternatively, when the delay of the valve closing time of the sucking valve occurs upon starting the ejecting drive or the valve closeness is incomplete, the ink which has to be ejected may flow backward to the ink cartridge. However, in the ink supply system 61 according to this embodiment, it is possible to prevent this problem.

(3) The locking positions of the locking hooks 66 and 67 are set not only in the circumference of the main body 62 but also in the inside portion thereof. That is, the plural (twelve) locking hooks 66 disposed along the whole circumference of the main body 62 and the plural (seven) locking hooks 67 arranged in the gap areas between the pumps 43 and the valves 41 and 45 inside the main body 62 are provided. With such a configuration, the sealing property can be ensured in the circumference by narrowing the gap between the passage forming plate 90 and the cover 70 in the circumference of the main body 62. Moreover, the gap between the sealing portions of the passage forming plate 90 and the cover 70 can be maintained so as to be narrow in the inside area of the main body 62. Accordingly, it is possible to ensure the sealing property of the pumps 43 and the valves 41 and 45 across the whole surface of the main body 62.

In the case of the configuration in which the locking hook 67 and the lockable member 133 as the second locking member are not provided, the passage forming plate 90 or the cover 70 made of a synthetic resin material may receive a compression reacting force of the diaphragm forming member 80 to be curved and thus deformed and the cover 70 may be detached from the passage forming plate 90 at the middle of the cover 70. In this case, the sealing property of the pumps 43 and the valves 41 and 45 is not ensured in the middle of the main body 62. In this embodiment, however, since the locking hooks 67 engage with the lockable members 133 not only in the circumference of the main body 62 but also in the inside portion, it is possible to prevent the detachment of the middle of the cover 70 from the passage forming plate 90. Accordingly, in the ink supply system 61 according to this embodiment, it is possible to surely ensure the sealing property of all the pumps 43 and the valves 41 and 45 in the whole surface of the main body 62.

(4) Since the plate spring 133*a* is formed in each of the lockable members 133 of the protective plate 130 which can engage with the locking hooks 67 locking at the positions located inside the main body 62 and the locking nail 133*b* is formed in the front end of the plate spring 133*a*. For example, the sealing portions of the pumps 43 and the valves 41 and 45 are formed in the diaphragm forming member 80 inside the main body 62 in a plan view. The degree that the sealing portions are inserted and compressed between the sealing portions of the passage forming plate 90 and the cover 70 is increased relatively than the circumference of the main body 62. Accordingly, a force relatively larger than a force applied to the engagement portions of the locking hooks 66 with the lockable members 132 is applied to the engagement portions of the locking hooks 67 with the lockable members 133 in a direction in which the locking is released. For example, when the force applied in the direction in which the locking is released exceeds a certain value, the locking nail is out of the locking hole of the locking hook and thus the sealing property may not be ensured in the middle of the main body. In some cases, the cover 70 is detached. In this embodiment, however, the plate spring 133*a* formed in the lockable member 133 is deformed in a direction (an upper direction in FIG. 16) in which the locking hook 67 is released due to the elasticity, as shown in FIG. 16, this serves as a cushion. Therefore, it is possible to avoid the deviation of the locking. In this case, since a force returning to the original position is applied to the plate spring 133*a*, the sealing portions of the diaphragm forming member 80 are compressed by an appropriate force and thus the sealing property is ensured. Accordingly, it is possible to ensure the sealing property by avoiding the release of the locking of the locking hooks 67. Moreover, it is possible to prevent the cover 70 from being released.

(5) Since the pumps 43, the sucking valves 41, and the ejecting valves 45 are disposed on the same plane, the ink supply system 61 can be formed so as to have the lamination structure. The lamination structure formed by laminating the plural members 70, 80, 90, 120, and 130 including the cover 70 and the passage forming plate 90 as the single passage forming member is used. Accordingly, the ink supply system 61 can be provided as the relatively thin component incorporated with the plural ink supply devices 14 including the pumps 43, the sucking valves 41, the ejecting valves 45, and the passages 15*a*, 15*b*, 15*c*, and 15*d*. Accordingly, the piping work is finished just by connecting the air passage tube 46*a* to the tube 106 and attaching a pipe connection tool 59 formed in the front end of the flexible pipe plate extending from the printing head unit 12 to the pipe connection section 63. As a consequence, since it is not necessary to carry out a piping work for connecting the pumps to the two unidirectional valves (the check valves) and a piping work for connecting the ink supply devices 14 to each other to share a working fluid to a pump between the ink supply devices, for example, a troublesome piping work may not be required and the piping work can be finished in a relatively simple manner.

(6) The passages permitting the pumps 43, the sucking valves 41, and the ejecting valves 45 to connect each other are disposed on the rear surface of the passage forming plate 90 by forming the passage grooves 101 to 105 on the rear surface of the passage forming plate 90 and welding the film 120 to the rear surface. Accordingly, since the pumps 43, the sucking valves 41, and the ejecting valves 45 provided on the front surface of the passage forming plate 90 and the passages 111 to 115 provided on the rear surface and permitting the pumps 43, the sucking valves 41, and the ejecting valves 45 to connect each other can be disposed so as to overlap with each other in the lamination direction (the Z direction), the size of the ink supply system 61 can be made compact in a plan view. As a consequence, it is possible to make the size of the ink supply system 61 compact in a plan view. Moreover, since the passages 111 to 115 on the rear surface of the passage forming plate 90 are disposed on the same plane, the ink supply system 61 is not thick and thus the thinness of the ink supply system 61 can be achieved.

(7) Since the pumps 43 are laid out relative to the ink supply needles 25 so that all the central points of the pumps 43 fall within the cartridge projection range, the space for disposing the ink supply system 61 mounted with the ink cartridges 13 can be relatively small. Moreover, since the valves 41 and 45 are also laid out relative to the ink supply needles 25 so that all the central points of the valves 41 and 45 fall within the cartridge projection range, the space for disposing the ink supply system 61 mounted with the ink cartridges 13 can be smaller.

(8) Since the protective plate 130 is disposed on the rear surface on which the film 120 of the passage forming plate 90 is welded, it is possible to prevent the rippling deformation of the passage forming plate 90 or the like caused because the locking portions of the locking hooks 66 and 67 receive a relatively large force than other portions. Accordingly, the flatness of the sealing surface before and after the locking is maintained and the sealing property of the ink supply system 61 can be ensured. Moreover, since the protective plate 130 is disposed on the rear surface of the passage forming plate 90, it is possible to protect the film 120 welded on the rear surface of the passage forming plate 90 to form the passages.

(9) In the ink supply system 61, the concave sections 30 and 33 individually forming parts of the valve chambers 41*a* and 45*a* of the sucking valves 41 (the sucking check valve) and the ejecting valve 45 (the ejecting check valve) are formed in the concave shape in the passage forming plate 90 which is the lower case provided with the concave sections 31 each forming a part of the pump chamber 43*a*. With such a configuration, it is possible to make the whole pump mechanism thin and make the ink supply system 61 compact.

For example, when the pump chamber 43*a*, the valve chamber 41*a*, and the valve chamber 45*a* are formed in the passage forming plate 90 (a lower case) without providing the concave section, it is necessary to form a relatively large concave section for forming the valve chamber in the cover 70 (an upper case) and the passage forming plate 90 is required to have the thickness corresponding to the concave section 31 of the pump chamber 43*a* of the passage forming plate 90. In this way, the lower and upper cases are separated from each other and the concave sections are formed, the thickness is larger and the ink supply system 61 becomes thick. In this embodiment, however, since the concave sections 30 and 32 for the valve chamber 41*a* of the sucking valve 41 and the valve chamber 45*a* of the ejecting valve 45 are provided in the passage forming plate 90 in which the concave sections 31 of the pump chambers 43*a* are formed, the concave section for the valve chamber of the cover 70 can be made thin and it is easy to make at least the portion other than the pumps 43 thin.

(10) The check valve chamber according to this embodiment is configured such that the inflow port to the valve chamber 41*a* is formed by the through-hole 31*b* opened to the bottom surface of the concave section 30 formed in the passage forming plate 90. In addition, the sucking valve body 36 is configured so as not to block the inflow port upon valve closeness of the sucking valve body 36. Accordingly, as for the valve chamber 41*a* of the sucking valve 41, the negative pressure (the ink pressure) from the pump chamber 43*a* upon the sucking drive of the pump is applied to the whole upper surface of the sucking valve body 36, and the ink pressure of the ink cartridge 13 is also applied to the surface (the lower surface) opposite to the sucking valve body 36 and a broad pressure receiving area with a ring shape. Therefore, due to the differential pressure based on the broad pressure receiving surface in both the surfaces of the sucking valve body 36, the sucking valve 41 can be opened or closed by a relatively small pressure variation and pressure loss can be reduced. Since the same is applied to the valve chamber 45*a* of the ejecting valve 45, the ejecting valve 45 can be opened or closed even by the relatively small pressure variation. On the contrary, in a valve such as a lead valve or a flap valve having a configuration in which the inflow port to each valve chamber is blocked by the valve body, the opening area of the inflow port blocked by the valve body is a pressure receiving area of the valve body. Therefore, when large negative pressure is not applied, it is difficult to surely open the valve. The same is applied to the valve chamber 45*a* of the ejecting valve 45. As described above, in this embodiment, the check valves of the sucking valve 41 and the ejecting valve 45 have the configuration in which the opening or closing operation can be surely performed even by the small pressure variation, and the pump mechanism can be made thin.

(11) Since all the members 70, 80, 90, 120, 130, and 140 are common to the six ink supply devices 14, the number of constituent elements is reduced and it is easy to assemble the ink supply system 61.

The invention is not limited to the above-described embodiment, but may be deformed in the following forms.

MODIFIED EXAMPLE 1

In the above-described embodiment, the locking hooks 66 and 67 as a locking member are provided in the cover 70 (the second passage forming member 28) as a second member and the lockable members are provided in the passage forming plate 90 (the first passage forming member 27) as a first member. However, the locking member and the lockable member may be provided conversely. In short, the locking member and the lockable member which is paired with the locking member may be provided in one and the other of the first and second members, respectively. In this case, in the configuration of the plural locking units, the member provided with the locking member and the member provided with the lockable member may be different from each other between the locking units.

MODIFIED EXAMPLE 2

The protective plate 130 may be removed. In this case, the locking members (the locking hooks) provided in one of the cover 70 (the second member) and the passage forming plate 90 (the first member) may engage with the lockable member (the locking nail) provided one thereof. In addition, when the protective plate 130 is removed, a locking force of a degree that the rippling shape of the passage forming member upon locking the locking unit, for example, is not deformed is set. Alternatively, a material having rigidity of a degree that the deformation does not occur upon locking the locking unit is used in the passage forming member.

MODIFIED EXAMPLE 3

The plural locking units may be formed by only the lockable members 133 having the plate spring. Alternatively, the plural locking units may be formed by only the lockable members 132 which have no plate spring.

MODIFIED EXAMPLE 4

The locking units are provided only at the positions along the circumference of the main body 62 of the ink supply system 61 and only the circumference of the main body 62 may be used as the locking portions.

MODIFIED EXAMPLE 5

The receiving plate 140 may be removed. When the film 120 is formed of a material having high solidity, the problem of damage can be prevented without the protective plate. In addition, when the sealing property is completely ensured and thus the ink does not leak, there is no problem with the removal of the receiving plate 140.

MODIFIED EXAMPLE 6

A configuration which does not use the film may be employed. For example, a configuration may be used in which the passage grooves are formed on the surface on the side of the passage forming plate facing the diaphragm forming member 80 and passages are formed by the spatial areas surrounded by the grooves and the diaphragm forming member 80 or passages are formed by holes formed in the passage forming member and extending in a direction perpendicular to the lamination direction. A configuration may be used in which plural passage forming members overlapped in the lamination direction are formed instead of one passage forming plate of the above-described embodiment, grooves are formed on at least one surface of the facing surfaces of plural (for example, two) passage forming members, and the passages are surrounded by the grooves and the facing surfaces upon laminating the plural passage forming plates.

MODIFIED EXAMPLE 7

The liquid supply device is not limited to the ink supply system formed by making the plural ink supply devices 14 into one unit. The ink supply device 14 for one color which includes one pump 43, one sucking valve 41, and one ejecting valve 45 may be used.

MODIFIED EXAMPLE 8

One of the cover 70 and the diaphragm forming member 80 may be the single member. For example, the cover may be formed by plural elements, the diaphragm forming member may be formed by plural elements, or both the cover and the diaphragm forming member may be formed by the same number of elements or a different number of elements. In this case, when the passage forming plate 90 is one component, the ink supply system 61 can be made into one unit.

MODIFIED EXAMPLE 9

The ink supply system 61 may not be the cartridge holder. For example, a configuration may be used in which a tube extending from an ink supply source such as an ink tank or the cartridge holder mounted with the ink cartridges is connected to the supply tubes of the ink supply system. Alternatively, an ink supply device including pumps, first unidirectional valves (sucking unidirectional valves), and second unidirectional valves (ejecting unidirectional valves), as in JP-A-2062-272661, may be mounted in the printing head unit. That is, the ink supply system 61 according to the above-described embodiment is mounted on the carriage. With such a configuration, by using the ink supply system 61 having the lamination structure, it is possible to reduce the piping work and make the ink supply device thin.

MODIFIED EXAMPLE 10

In the above-described embodiment, the ink jet printer and the ink cartridge have been used. However, a liquid ejecting apparatus discharging or ejecting another liquid other than ink and a liquid storing unit storing the liquid may be used. The invention is useful for various liquid ejecting apparatuses including a liquid ejecting head for ejecting minute liquid droplets. The liquid droplet refers to a liquid ejected from the liquid ejecting apparatus and includes a liquid having a particle shape, a liquid having a droplet shape, and a liquid having a thread trailing shape. The liquid is a material which can be ejected by the liquid ejecting apparatus. For example, the liquid is a matter in a liquefied state and includes a liquid of a fluid state such as a liquid-like material having high or low viscosity, sol, gel water, other inorganic solvents, an organic solvent, liquid solution, liquid-like resin, and liquid-like metal (metallic melt), a liquid in one state of a matter, and a liquid in which particles of a functional material formed of a solid matter such as colorant or metal particle is dissolved, dispersed, or mixed. Representative examples of a liquid are ink or liquid crystal, as described in the embodiment. Here, the ink includes a liquid composition such as general water-based ink, general oil-based ink, gel ink, and hot-melt ink. Specific examples of the liquid ejecting apparatus include a liquid crystal display, an EL (electro-luminescence) display, a plane emission display, a liquid ejecting apparatus ejecting a liquid containing a material such as an electrode material or a color material used to manufacture a color filter is dispersed or dissolved, a liquid ejecting apparatus ejecting bio organism used to manufacture a bio chip, a liquid ejecting apparatus ejecting a liquid as a sample used by a precise pipette, a printing apparatus, and a micro dispenser. In addition, examples of the liquid ejecting apparatus include a liquid ejecting apparatus ejecting a lubricant to a precision instrument such as a clock or a camera by a pin point, a liquid ejecting apparatus ejecting a transparent resin liquid such as ultraviolet cured resin on a board to form a minute hemispheric lens (an optical lens) used in an optical communication element or the like, and a liquid ejecting apparatus ejecting an acid or alkali etching liquid to etch a board or the like. In addition, the invention is applicable to one liquid ejecting thereof and the liquid storing unit.

The technical sprints understood from the above-described embodiment and the modified examples will be described below.

(1) In the liquid supply device, the flexible member includes the diaphragms of the supply pumps and valve portions of the unidirectional valves.

(2) In the liquid supply device, a connection section (25) for connecting a supply port of the liquid storing member (13) is provided on the outer surface of at least one of the first and second members. With such a configuration, since the connection port of the liquid supply source is directly connected to the liquid supply connection section, a tube or the like is not required to connect the liquid supply source and the liquid supply connection section to each other.

(3) In the liquid supply device according to technical spirit (2), the liquid supply source is a liquid cartridge storing a liquid, the connection section is a liquid supply needle inserted into the supply port of the liquid storing member, and the liquid supply device is a cartridge holder mounted with the liquid cartridge in which the liquid supply needle is inserted into the supply port of the liquid cartridge. With such a configuration, since the liquid supply device is formed such that the pumps and the unidirectional valves are assembled in the cartridge holder on which the liquid supply source (the liquid cartridge) is directly mounted, it is not necessary to pipe a tube or the like for connecting the liquid supply source to the liquid supply device.

What is claimed is:

1. A liquid supply device comprising:

a supply pump which is provided in a liquid supply passage;

a first unidirectional valve which is provided on an upstream side of the supply pump;

a second unidirectional valve which is provided on a downstream side of the supply pump;

a first member;

a second member; and a flexible member, wherein the supply pump and the first and second unidirectional valves are formed such that the flexible member is part of the pump and the first and second unidirectional valves such that flexible member is interposed between the first and second members and held by locking a locking unit in the state where the flexible member is interposed between the first and second members.

2. The liquid supply device according to claim 1, wherein the locking unit holds a plurality of members including the first and second members by locking and includes a locking member which is provided in one outer member of the plurality of members and a lockable member which is provided in another outer member thereof disposed opposite to the one outer member and engages with the locking member.

3. The liquid supply device according to claim 2, wherein a metal plate which is one of the plurality of members is disposed on the surface of at least one of the first and second members opposite to the flexible member, and the locking member locks the lockable member formed on the metal plate.

4. The liquid supply device according to claim 2, wherein the lockable member has a plate spring which is elastically deformable.

5. The liquid supply device according to claim 2, wherein the locking unit includes first locking members which lock at a plurality of positions in the circumference of a main body formed by interposing the flexible member between the first and second members and second locking members which lock at locking positions located more inside than the locking positions of the first locking members in the main body.

6. The liquid supply device according to claim 5, wherein the second locking member has a plate spring.

7. The liquid supply device according to claim 5, further comprising:

a plurality of liquid supply units which each include the supply pump and the first and second unidirectional valves, wherein plural pairs of the supply pumps and the first and second unidirectional valves individually forming the plurality of liquid supply units are disposed on the substantially same plane, wherein at least one of the first and second members is provided with concave sections for each forming a part of each chamber of the supply pump and each unidirectional valve, and wherein the locking positions of the second locking members are located in gap areas where the concave sections are not disposed.

8. The liquid supply device according to claim 1, wherein at least one of the first and second members has a groove on a surface opposite to the flexible member, wherein a part of the liquid supply passage is formed on a surface of at least one of the first and second members opposite to the supply pumps by a spatial area surrounded by the groove and a blocking member by fixing the blocking member on the surface provided with the groove in a sealed state, and wherein the locking positions of the locking unit are located in gap areas where a part of the liquid supply passage is not formed.

9. A liquid ejecting apparatus comprising:

the liquid supply device according to claim 1; and a liquid ejecting unit which ejects a liquid supplied from the liquid supply device.

* * * * *